US010663888B2

(12) United States Patent
Mimura

(10) Patent No.: US 10,663,888 B2
(45) Date of Patent: May 26, 2020

(54) DEVELOPER CONTAINER, IMAGE FORMING UNIT, IMAGE FORMING APPARATUS, AND DEVELOPER CONTAINER CONTROL METHOD

(71) Applicant: Oki Data Corporation, Minato-ku, Tokyo (JP)

(72) Inventor: Takanori Mimura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/388,918

(22) Filed: Apr. 19, 2019

(65) Prior Publication Data

US 2019/0332035 A1 Oct. 31, 2019

(30) Foreign Application Priority Data

Apr. 27, 2018 (JP) ..... 2018-087247

(51) Int. Cl.
*G03G 15/08* (2006.01)

(52) U.S. Cl.
CPC ..... *G03G 15/0889* (2013.01); *G03G 15/0865* (2013.01); *G03G 15/0875* (2013.01); *G03G 15/0877* (2013.01); *G03G 2215/0802* (2013.01); *G03G 2215/085* (2013.01); *G03G 2215/0816* (2013.01)

(58) Field of Classification Search
CPC ..... G03G 15/0889; G03G 15/0865; G03G 15/0875; G03G 15/0877; G03G 2215/0802; G03G 2215/0816; G03G 2215/085
See application file for complete search history.

(56) References Cited

U.S. PATENT DOCUMENTS

2002/0150405 A1* 10/2002 Tanisawa ..... G03G 21/12 399/120
2008/0080899 A1 4/2008 Mase
2009/0245877 A1* 10/2009 Choi ..... G03G 15/0877 399/254
2013/0308965 A1* 11/2013 Tsuchiya ..... G03G 15/086 399/27

(Continued)

FOREIGN PATENT DOCUMENTS

EP 0661609 A2 7/1995
EP 3185076 A1 6/2017
JP 2017203940 A 11/2017

*Primary Examiner* — Ryan D Walsh
(74) *Attorney, Agent, or Firm* — Panitch Schwarze Belisario & Nadel LLP

(57) ABSTRACT

A developer container includes a body, an agitating bar, and an agitating film. The body includes a bottom plate; a first side wall; a second side wall facing the first side wall; a developer chamber defined by the bottom plate, the first side wall, and the second side wall, the developer chamber storing developer; and an opening formed in the bottom plate to allow the developer chamber to communicate with an outside of the developer chamber and allow the developer to be supplied from the developer chamber to the outside of the developer chamber. The agitating bar is configured to rotate to agitate the developer stored in the developer chamber. The agitating film is attached to the agitating bar and configured to, when rotation of the agitating bar stops, stop in a state where the agitating film abuts the first side wall and the second side wall.

14 Claims, 10 Drawing Sheets

(56) References Cited

U.S. PATENT DOCUMENTS

| | | | | |
|---|---|---|---|---|
| 2014/0321885 | A1* | 10/2014 | Fujimori | G03G 15/0875 399/258 |
| 2015/0261134 | A1* | 9/2015 | Kikuchi | G03G 15/0889 399/254 |
| 2017/0068205 | A1 | 3/2017 | Shinotsuka et al. | |
| 2019/0064701 | A1* | 2/2019 | Tanimoto | G03G 15/0889 |

* cited by examiner

DEVELOPER CONTAINER, IMAGE FORMING UNIT, IMAGE FORMING APPARATUS, AND DEVELOPER CONTAINER CONTROL METHOD

CROSS-REFERENCE TO RELATED APPLICATION

This application claims priority under 35 U.S.C. § 119(b) to Japanese Application No. 2018-087247, filed Apr. 27, 2018, the disclosure of which is incorporated by reference herein in its entirety.

BACKGROUND OF THE INVENTION

1. Field of the Invention

The present invention relates to a developer container, an image forming unit, an image forming apparatus, and a developer container control method, and is preferably applied to, for example, an electrophotographic image forming apparatus, such as a printer or a copier.

2. Description of the Related Art

Conventionally, there is an image forming apparatus in which an integrated developer container including developer chambers storing developers of different colors is detachably attachable to image forming portions and when the developer of any of the colors in the developer container has run out, the developer container is replaced with a new one (see, e.g., Japanese Patent Application Publication No. 2017-203940). In such an image forming apparatus, the developers are supplied from the developer chambers of the developer container to the image forming portions as appropriate.

However, in particular when a large amount of developer remains in a developer chamber, the developer located in a lower part of the developer chamber is pressed by the toner located in an upper part of the developer chamber. This may cause the toner located in the lower part to aggregate and deteriorate, degrading print quality.

SUMMARY OF THE INVENTION

An object of an aspect of the present invention is to provide a developer container, an image forming unit, an image forming apparatus, and a developer container control method capable of improving print quality.

According to an aspect of the present invention, there is provided a developer container including a body, an agitating bar, and an agitating film. The body includes a bottom plate; a first side wall; a second side wall facing the first side wall; a developer chamber defined by the bottom plate, the first side wall, and the second side wall, the developer chamber storing developer; and an opening formed in the bottom plate to allow the developer chamber to communicate with an outside of the developer chamber and allow the developer to be supplied from the developer chamber to the outside of the developer chamber. The agitating bar is configured to rotate to agitate the developer stored in the developer chamber. The agitating film is attached to the agitating bar and configured to, when rotation of the agitating bar stops, stop in a state where the agitating film abuts the first side wall and the second side wall.

DETAILED DESCRIPTION OF THE INVENTION

Embodiments of the present invention will now be described with reference to the attached drawings.

1. First Embodiment

<1-1. Configuration of Image Forming Apparatus>

Figure 1:
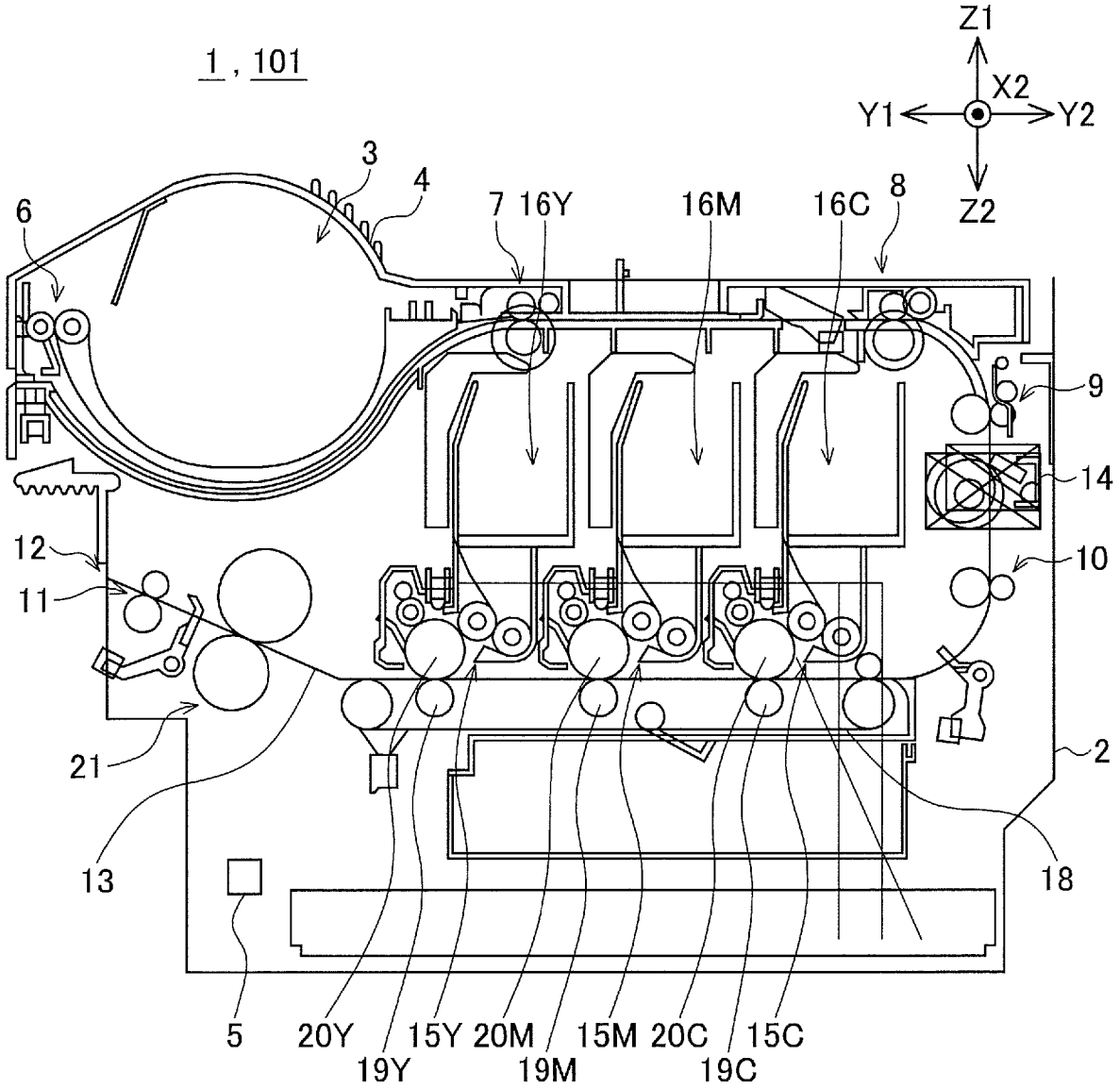
FIG. 1 is a sectional view illustrating an internal configuration of an image forming apparatus.

As illustrated in FIG. 1, an image forming apparatus 1 is, for example, a roll paper printer with an image forming unit 22 (see FIG. 3) using an electrophotographic method, and includes a substantially box-shaped housing 2. The following description defines the left side of the plane of the drawing sheet of FIG. 1 as the front side, the right side of the plane as the rear side, the front side of the plane as the right side, the rear side of the plane as the left side, the upper side of the plane as the upper side, and the lower side of the plane as the lower side. In the drawings, the leftward, rightward, forward, rearward, upward, and downward directions are indicated by arrows X1, X2, Y1, Y2, Z1, and Z2, respectively.

The housing 2 houses a controller 5 that entirely controls the image forming apparatus 1. The controller 5 includes, as its central component, a central processing unit (CPU) (not illustrated), and controls units to perform a printing process and other processes, by reading a predetermined program from a storage unit including a read only memory (ROM), a random access memory (RAM), a hard disk drive, a flash memory, or the like and executing the program.

Figure 2:
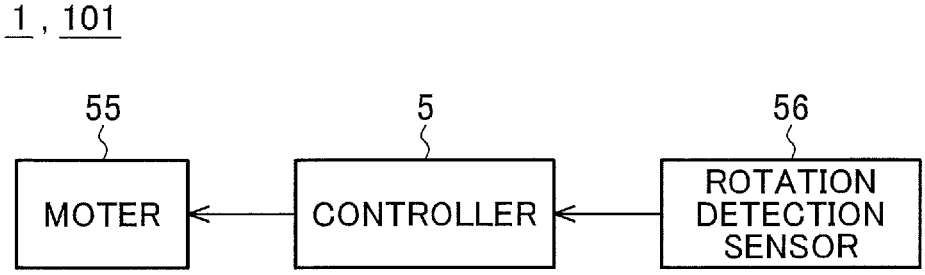
FIG. 2 is a block diagram illustrating a control configuration of the image forming apparatus.

As illustrated in FIG. 2, the image forming apparatus 1 includes a motor 55 as a drive source. The controller 5 rotates the motor 55, thereby causing a rotational driving force to be transmitted to an agitating bar 60 (see FIG. 10) through a drive gear 32 and an agitation gear 75 (see FIG. 4) to rotate the agitating bar 60, and thereby rotating agitating films (or agitating members) 61C, 61M, and 61Y attached to the agitating bar 60 (see FIG. 8). The agitating films 61C, 61M, and 61Y may be referred to as the agitating films 61. The drive gear 32, agitation gear 75, agitating bar 60, and agitating films 61 will be described later. The image forming apparatus 1 also includes a rotation detection sensor 56 using a photosensor, an encoder, or the like. The controller 5 determines the attitude of the agitating films 61 (to be described later) on the basis of a detection result received from the rotation detection sensor 56 (see FIG. 5), and controls the attitude of the agitating films 61 by rotating the motor 55 on the basis of the determined attitude of the agitating films 61.

The image forming apparatus 1 includes toner chambers (or toner storing portions) 35C, 35M, and 35Y (see FIG. 8) that stores toners of different colors. The toner chambers 35C, 35M, and 35Y may be referred to as the toner chambers 35. The toner chambers 35 will be described later. The controller 5 of the image forming apparatus 1 determines the amount of toner remaining in each toner chamber 35 by a dot count method.

A paper roll holder 3 that holds a cylindrical paper roll is disposed on the front side of an upper portion of the housing 2 (see FIG. 1). A cover 4 that covers the paper roll holder 3 is attached to the housing 2 above the paper roll holder 3. The image forming apparatus 1 is configured so that the cylindrical paper roll is stored in a cylindrical space consisting of a storage space of the paper roll holder 3 and an inner space of the cover 4 closed. The paper roll holder 3 is provided with a pair of conveying rollers 6 at an upper portion of a front end of the storage space. When the cover 4 is closed, a front one of the pair of conveying rollers 6 abuts a rear one of the pair of conveying rollers 6, and conveys paper (or a paper sheet) from the paper roll while nipping the paper.

A conveying path 13 is provided in the housing 2 of the image forming apparatus 1. The conveying path 13 extends from a front end of the paper roll holder 3 to a rear end of the paper roll holder 3 along a lower portion of the paper roll holder 3 and further extends through pairs of conveying rollers 7, 8, 9, 10, and 11 to a paper outlet 12. The conveying path 13 is a path for conveying the paper from the paper roll stored in the paper roll holder 3 to the paper outlet 12, with the paper roll holder 3 side as the upstream side and the paper outlet 12 side as the downstream side.

The pairs of conveying rollers 6, 7, 8, 9, 10, and 11 are pairs of rollers that nip and convey the paper from the paper roll. The pairs of conveying rollers 6, 7, 8, 9, 10, and 11 are arranged in this order from the upstream side of the conveying path 13.

A housing side cutter 14 that cuts the paper is disposed between the pair of conveying rollers 9 and the pair of conveying rollers 10. Image forming portions 15C, 15M, and 15Y of the image forming unit 22 (see FIG. 3) are arranged along the conveying path 13 between the pair of conveying rollers 10 and the pair of conveying rollers 11. The image forming portions 15C, 15M, and 15Y may be referred to as the image forming portions 15. The image forming portions 15C, 15M, and 15Y form toner images as developer images of different colors (e.g., three colors). The image forming portions 15C, 15M, and 15Y are arranged in this order from the upstream side of the conveying path 13. The image forming portions 15C, 15M, and 15Y include storing portions 16C, 16M, and 16Y that store their respective toners. The storing portions 16C, 16M, and 16Y may be referred to as the storing portions 16.

A transfer belt 18 and transfer rollers 19C, 19M, and 19Y are disposed below the image forming portions 15C, 15M, and 15Y. The transfer belt 18 is annular and extends along the conveying path 13 in the front-rear direction. The transfer rollers 19C, 19M, and 19Y are arranged to respectively face photosensitive drums 20C, 20M, and 20Y of the image forming portions 15C, 15M, and 15Y with the transfer belt 18 therebetween. A fixing unit 21 is disposed downstream of the transfer belt 18 in the conveying path 13. The pair of conveying rollers 11 is disposed downstream of the fixing unit 21 and near the paper outlet 12.

In this configuration, the paper roll is set in the paper roll holder 3 by a user in such a manner that a leading end portion of the paper is drawn from the paper roll in front of the paper roll holder 3. Then, the cover 4 is closed, and the paper is nipped by the pair of conveying rollers 6.

With the paper nipped by the pair of conveying rollers 6, the image forming apparatus 1 rotates the rear one of the pair of conveying rollers 6 and rotates one of each of the pairs of conveying rollers 7, 8, 9, 10, and 11, thereby conveying the paper to the transfer belt 18 along the conveying path 13. The image forming apparatus 1 conveys the paper conveyed to the transfer belt 18 by means of the transfer belt 18 and causes the paper to sequentially pass through between the photosensitive drums 20C, 20M, and 20Y of the image forming portions 15C, 15M, and 15Y and the transfer rollers 19C, 19M, and 19Y. At this time, toner images formed on surfaces of the photosensitive drums 20C, 20M, and 20Y are transferred onto a printing surface of the paper. The image forming apparatus 1 conveys the paper with the toner images transferred thereon to the fixing unit 21, fixes the toner images to the paper by means of the fixing unit 21, and then discharges the paper through the paper outlet 12 by means of the pair of conveying rollers 11. The paper is cut by the housing side cutter 14 to a predetermined length. Thus, the image forming apparatus 1 discharges a printed sheet cut to the predetermined length through the paper outlet 12.

<1-2. Configuration of Image Forming Unit>

Figure 3:
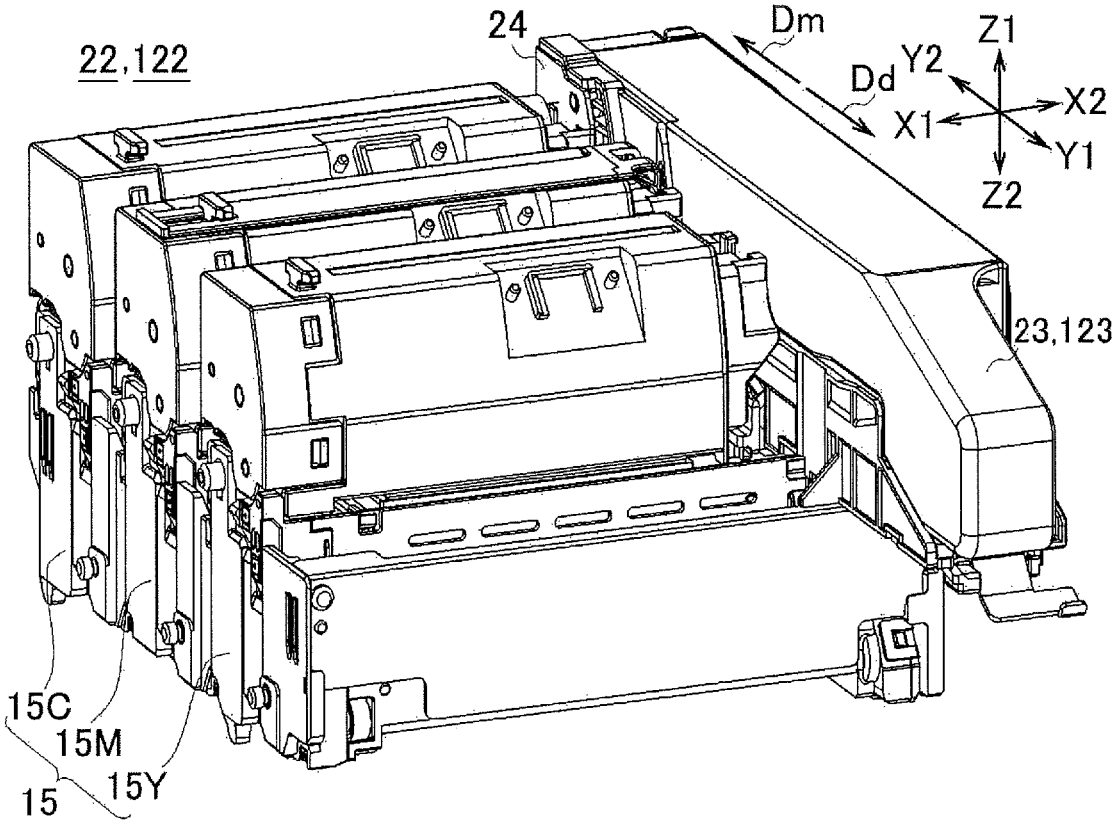
FIG. 3 is a perspective view illustrating an external configuration of an image forming unit.

As illustrated in FIG. 3, the image forming unit 22 includes a toner cartridge 23, a stage 24, and the image forming portions 15.

The image forming portions 15 (i.e., image forming portions 15C, 15M, and 15Y) form toner images as developer images using the electrophotographic method. The image forming portions 15 include the photosensitive drums 20C, 20M, and 20Y (see FIG. 1) (also referred to as the photosensitive drums 20) serving as rotatable image carriers, charging units that uniformly charge the surfaces of the photosensitive drums 20, exposure units that selectively illuminate the charged surfaces of the photosensitive drums 20 with light to form electrostatic latent images, and developing units that supply toner to the electrostatic latent images formed on the photosensitive drums 20 to form toner images. For example, the image forming portion 15Y forms a yellow toner image, the image forming portion 15M forms a magenta toner image, and the image forming portion 15C forma a cyan toner image. The image forming portions 15Y, 15M, and 15C are arranged in sequence in the front-rear direction, which is parallel to a medium conveying direction in which the medium is conveyed.

The stage 24 is disposed on the right side of the image forming portions 15 in the left-right direction, which is perpendicular to the medium conveying direction. The stage 24 allows the toner cartridge 23 to be detachably attached to the image forming portions 15.

The toner cartridge 23, serving as a developer container, stores the toners of the different colors, and is detachably attachable to the stage 24. When the amount of toner in any of the image forming portions 15C, 15M, and 15Y has become low or insufficient, the toner cartridge 23 attached to the stage 24 is removed, a new toner cartridge 23 storing the toners of the different colors is inserted into the stage 24 in a toner cartridge attachment direction Dm and attached to the stage 24, and thereby the toners of the different colors are supplied to the image forming portions 15C, 15M, and 15Y.

<1-3. Configuration of Stage>

Figure 5:
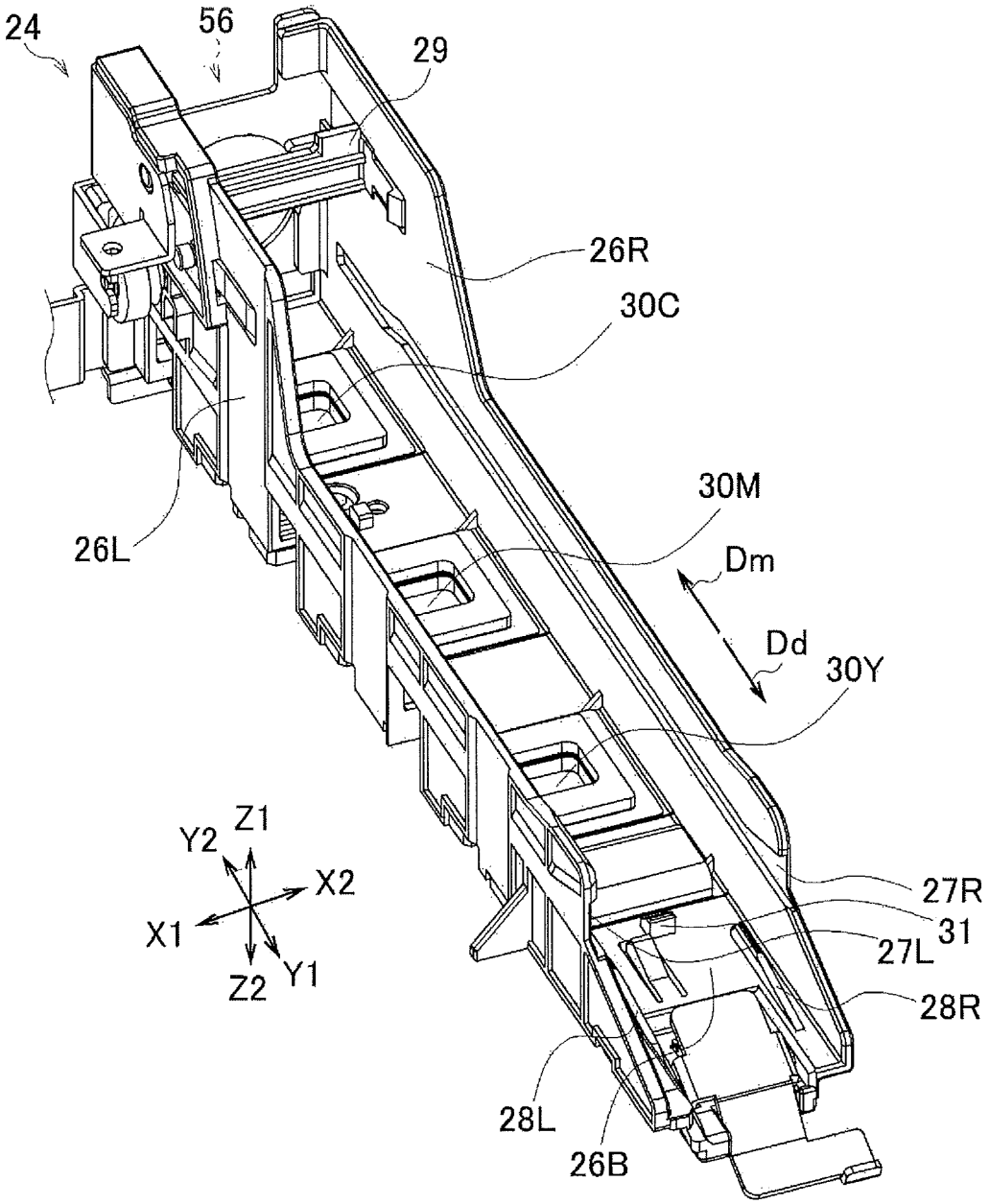
FIG. 5 is a perspective view illustrating an external configuration of the stage.

As illustrated in FIG. 5, the stage 24 includes side walls 26L and 26R, a bottom plate 26B, rails 27L and 27R, and limiters 28L and 28R. The stage 24 is fixed to the image forming portions 15 (see FIG. 3) with screws (not illustrated). The stage 24 is disposed on the right sides of the image forming portions 15. The stage 24 has, in its lower portion, three stage supply openings 30C, 30M, and 30Y for supplying toner to the image forming portions 15. The stage supply openings 30C, 30M, and 30Y may be referred to as stage supply openings 30. When the toner cartridge 23 is attached to the stage 24, the stage supply openings 30C, 30M, and 30Y of the stage 24 coincide with shutter supply openings 48C, 48M, and 48Y of a shutter 38 of the toner cartridge 23 (see FIG. 7B), allowing the toner to be supplied from the toner cartridge 23 to the image forming portions 15C, 15M, and 15Y.

Figure 7A:
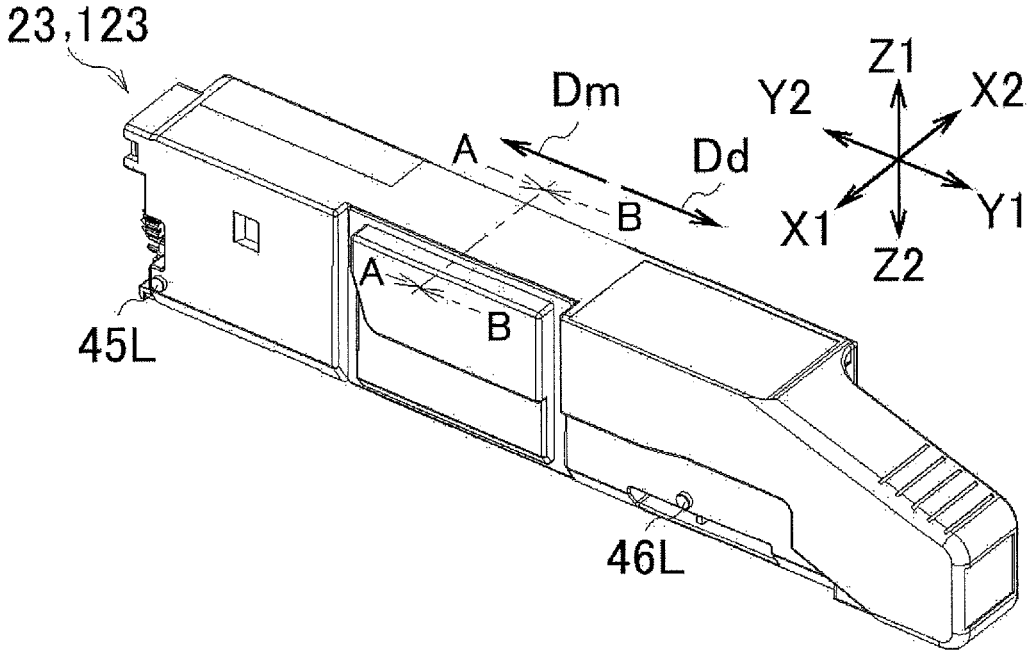
FIGS. 7A and 7B illustrate an external configuration of the toner cartridge, FIG. 7A being a top perspective view, FIG. 7B being a bottom perspective view.
Figure 7B:
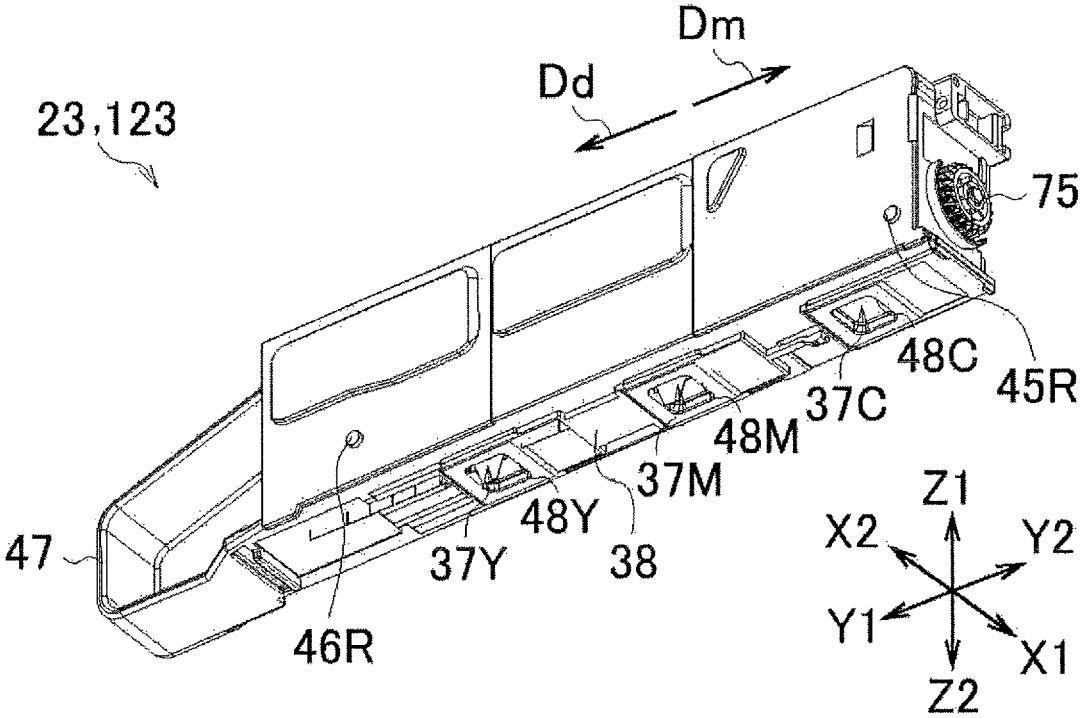

The side walls 26L and 26R are walls formed on both the left and right sides of the stage 24. The bottom plate 26B is formed between the side walls 26L and 26R and forms a bottom portion of the stage 24. The rails 27L and 27R are guide grooves respectively formed similarly in inner sides of the side walls 26L and 26R to extend in the toner cartridge attachment direction Dm. When the toner cartridge 23 is attached to the stage 24, the rails 27L and 27R slidably guide the toner cartridge 23. At this time, posts 45L and 45R and posts 46L and 46R formed on both sides of the toner cartridge 23 illustrated in FIGS. 7A and 7B are fitted in the rails 27L and 27R, thereby limiting the motion of the toner cartridge 23.

The limiters 28L and 28R are projection-shaped members having predetermined heights. The limiters 28L and 28R are formed between the side walls 26L and 26R in the left-right direction and formed on both the left and right sides of the bottom plate 26B to extend in the toner cartridge attachment direction Dm. When the posts 45L and 45R of the toner cartridge 23 illustrated in FIGS. 7A and 7B are fitted in the rails 27L and 27R, the limiters 28L and 28R abut both sides of a bottom surface of the toner cartridge 23, thereby separating the bottom surface of the toner cartridge 23 from the bottom plate 26B to prevent toner adhering to the bottom surface of the toner cartridge 23 from adhering to the bottom plate 26B and prevent toner adhering to the bottom plate 26B from adhering to the bottom surface of the toner cartridge 23.

Figure 6:
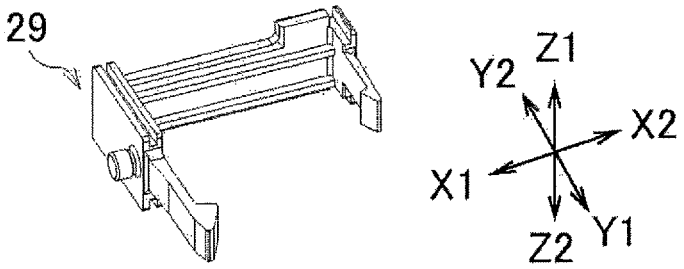
FIG. 6 is a perspective view illustrating an external configuration of a holder.

Near a rear end of the stage 24, a holder 29 illustrated in FIG. 6 is disposed between the side walls 26L and 26R slidably in insertion and removal directions of the toner cartridge 23. The holder 29 is provided with claws and latches the toner cartridge 23 from the left and right sides.

The stage supply openings 30C, 30M, and 30Y are formed in the bottom plate 26B. In the toner cartridge attachment direction Dm, the stage supply openings 30C, 30M, and 30Y have the same lengths as frame supply openings 37C, 37M, and 37Y of the toner cartridge 23 illustrated in FIG. 7B, and are arranged at the same intervals as the frame supply openings 37C, 37M, and 37Y of the toner cartridge 23. The stage supply openings 30C, 30M, and 30Y face the frame supply openings 37C, 37M, and 37Y in a toner cartridge attachment state where the toner cartridge 23 has been attached to the stage 24.

The stage supply openings 30C, 30M, and 30Y are disposed to respectively face the image forming portions 15C, 15M, and 15Y (see FIG. 3) and allow the toner chambers 35 of the toner cartridge 23 to communicate with the image forming portions 15 in the toner cartridge attachment state. Thus, the stage supply openings 30C, 30M, and 30Y allow toner passing through the frame supply openings 37C, 37M, and 37Y of the toner cartridge 23 to further pass therethrough and be supplied to the image forming portions 15C, 15M, and 15Y.

The bottom plate 26B has a claw 31 (see FIG. 5) formed thereon. When the toner cartridge 23 is attached to the stage 24, the claw 31 engages a shutter hole 51 (see FIG. 8) of the shutter 38, thereby limiting movement of the shutter 38 in the toner cartridge attachment direction Dm.

Figure 4:
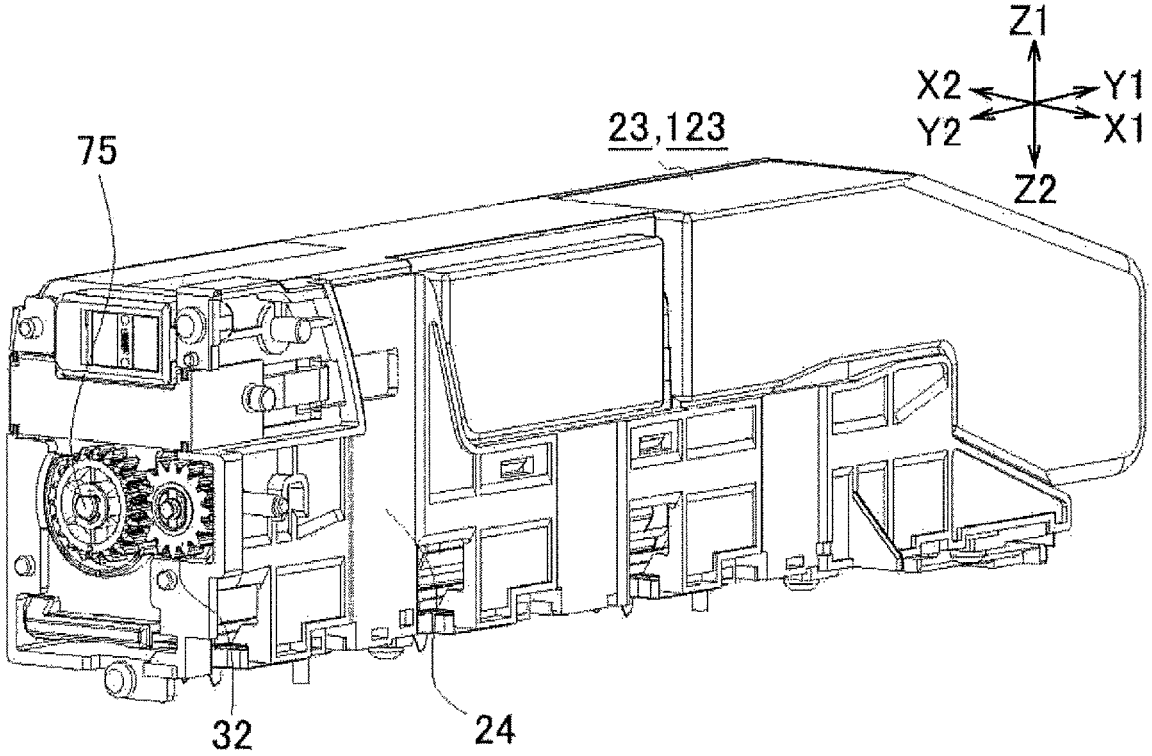
FIG. 4 is a perspective view illustrating external configurations of a stage and a toner cartridge in a toner cartridge attachment state.

As illustrated in FIG. 4, the drive gear 32 is rotatably disposed on a rear end surface of the stage 24. The drive gear 32 receives a rotational drive force from the motor 55 (see FIG. 2) of the image forming apparatus 1 under control of the controller 5 and rotates, thereby transmitting the rotational drive force to the agitation gear 75. The rotation detection sensor 56 is disposed on a rear end surface side of the stage (see FIG. 5). The rotation detection sensor 56 detects a rotational position of a projection 75*b* of the agitation gear 75 (see FIG. 9) and outputs a result of the detection to the controller 5. The controller 5 determines the attitude of the agitating films 61 on the basis of the detection result, and controls the attitude of the agitating films 61 by rotating the motor 55 on the basis of the determined attitude of the agitating films 61.

<1-4. Configuration of Toner Cartridge>

<1-4-1. External Configuration of Toner Cartridge>

As illustrated in FIGS. 7A and 7B, the toner cartridge 23 has a left side surface on which the posts 45L and 46L are formed, and a right side surface on which the posts 45R and 46R are formed. The posts 45L, 46L, 45R, and 46R are substantially cylindrical. The posts 45L and 45R are formed on the front side of the toner cartridge 23, and the posts 46L and 46R are formed on the rear side of the toner cartridge 23.

A handle 47 for an operator to handle the toner cartridge 23 is formed at a rear end of the toner cartridge 23. While gripping the handle 47, an operator moves the toner cartridge 23 relative to the stage 24 (see FIG. 5) in the toner cartridge attachment direction Dm to attach the toner cartridge 23 to the stage 24, and also moves the toner cartridge 23 relative to the stage 24 (see FIG. 5) in a toner cartridge removal direction Dd opposite to the toner cartridge attachment direction Dm to remove the toner cartridge 23 from the stage 24.

<1-4-2. Inner Configuration of Toner Cartridge>

Figure 8:
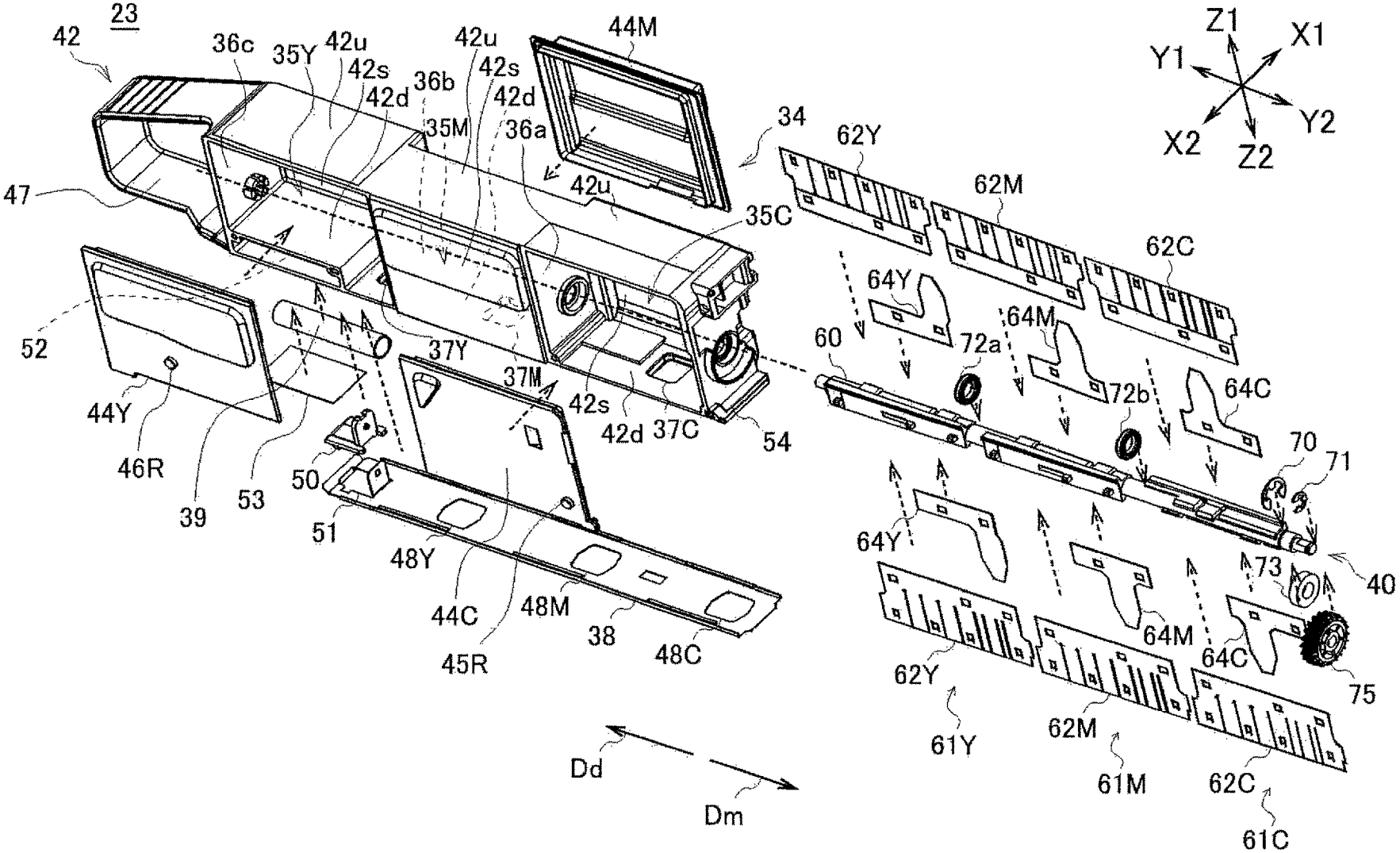
FIG. 8 is an exploded perspective view illustrating a configuration of the toner cartridge of a first embodiment.

As illustrated in FIG. 8, the toner cartridge 23 includes a body (or exterior member) 34, the toner chambers 35C, 35M, and 35Y, partitions 36*a*, 36*b*, and 36*c*, the frame supply openings 37C, 37M, and 37Y, the shutter 38, a spring 39, and an agitator 40. The frame supply openings 37C, 37M, and 37Y may be referred to as the frame supply openings 37.

The toner chambers 35 (i.e., toner chambers 35Y, 35M, and 35C), serving as developer chambers (or developer storing portions), are multiple storing chambers (or spaces) that store the toners of the different colors. The toner chambers 35 are arranged in the toner cartridge removal direction Dd. The toner chamber 35Y stores yellow toner, the toner chamber 35M stores magenta toner, and the toner chamber 35C stores cyan toner. The toner chambers 35Y, 35M, and 35C are arranged in this order from the handle 47 side in the toner cartridge attachment direction Dm. The toner chambers 35Y, 35M, and 35C are arranged to correspond to the image forming portions 15C, 15M, and 15Y (see FIG. 3), respectively.

The body 34 includes a frame (or outer member) 42 and caps (or covers) 44C, 44M, and 44Y. The frame 42 forms the handle 47 and toner chambers 35C, 35M, and 35Y. The caps 44C, 44M, and 44Y are plate-shaped members extending in the up-down direction. The caps 44C, 44M, and 44Y may be referred to as the caps 44.

The frame 42 is separated by the three partitions 36*a*, 36*b*, and 36*c* extending in the up-down direction. The partition 36*c* is disposed between the toner chamber 35Y and the handle 47, and separates the toner chamber 35Y and handle 47. The partitions 36*a* and 36*b* are walls that separate the toner chambers 35. The partition 36*a* is disposed between the toner chambers 35C and 35M, and separates the toner chambers 35C and 35M. The partition 36*b* is disposed between the toner chambers 35M and 35Y, and separates the toner chambers 35M and 35Y.

The frame 42 includes a frame side wall 42*s* formed on the left side of the toner chamber 35C, a frame bottom plate 42*d* formed on the lower side of the toner chamber 35C, and a frame top plate 42*u* formed on the upper side of the toner chamber 35C. The frame side wall 42*s* is a plate-shaped member extending in the up-down direction. The frame bottom plate 42*d* is a plate-shaped member extending in the left-right direction. The frame top plate 42*u* is a plate-shaped member extending in the left-right direction. The toner chamber 35C is open on its right side. Thus, a transverse section of a portion of the frame 42 forming the toner chamber 35C has a U-shape that opens rightward. An entire edge of the cap 44C is welded to an opening portion of the frame 42 on the right side of the toner chamber 35C. Thus, a transverse section of a portion of the body 34 forming the toner chamber 35C is rectangular.

The frame 42 also includes a frame side wall 42*s* formed on the right side of the toner chamber 35M, a frame bottom plate 42*d* formed on the lower side of the toner chamber 35M, and a frame top plate 42*u* formed on the upper side of the toner chamber 35M. The frame side wall 42*s* is a plate-shaped member extending in the up-down direction. The frame bottom plate 42*d* is a plate-shaped member extending in the left-right direction. The frame top plate 42*u* is a plate-shaped member extending in the left-right direction. The toner chamber 35M is open on its left side. An entire edge of the cap 44M is welded to an opening portion of the frame 42 on the left side of the toner chamber 35M.

The frame 42 also includes a frame side wall 42*s* formed on the left side of the toner chamber 35Y, a frame bottom plate 42*d* formed on the lower side of the toner chamber 35Y, and a frame top plate 42*u* formed on the upper side of the toner chamber 35Y. The frame side wall 42*s* is a plate-shaped member extending in the up-down direction. The frame bottom plate 42*d* is a plate-shaped member extending in the left-right direction. The frame top plate 42*u* is a plate-shaped member extending in the left-right direction. The toner chamber 35Y is open on its right side. An entire edge of the cap 44Y is welded to an opening portion of the frame 42 on the right side of the toner chamber 35Y.

Figure 10:
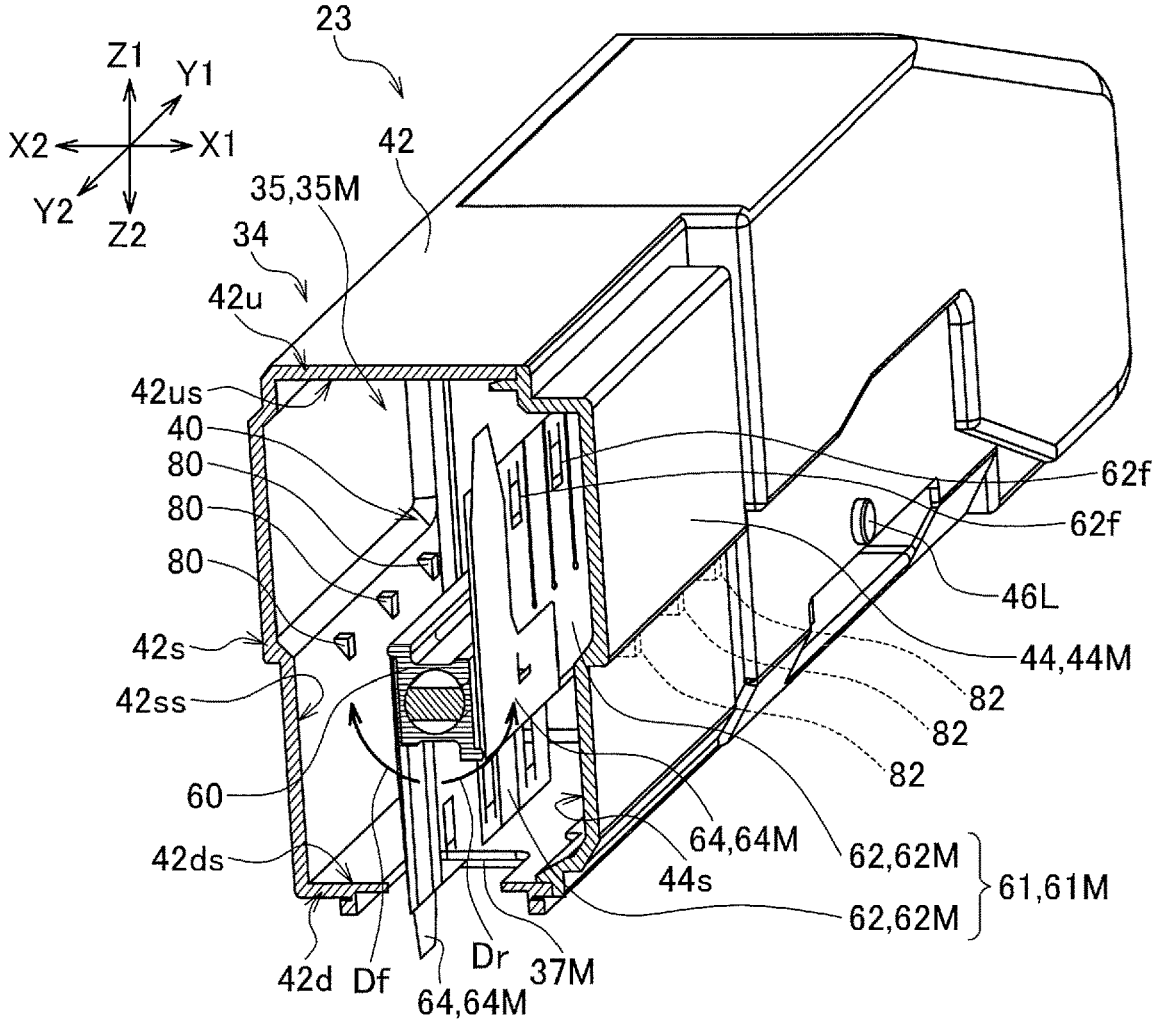
FIG. 10 illustrates an internal configuration of the toner cartridge of the first embodiment, and is a sectional perspective view taken along line A-A in FIG. 7A.

As illustrated in FIG. 10, for each of the toner chambers 35, a side wall inner surface 42*ss* is formed on a side of the frame side wall 42*s* facing the toner chamber 35. The side wall inner surface 42*ss* is substantially planar and extends in the up-down direction. A cap inner wall surface 44*s* is formed on a side of the cap 44 facing the toner chamber 35. The cap inner wall surface 44*s* is substantially planar and extends in the up-down direction. The side wall inner surface 42*ss* and cap inner wall surface 44*s* face each other with the agitating bar 60 therebetween. A top plate inner surface 42*us* is formed on a side of the frame top plate 42*u* facing the toner chamber 35. The top plate inner surface 42*us* is substantially planar and extends in the left-right direction. A bottom plate inner surface 42*ds* is formed on a side of the frame bottom plate 42*d* facing the toner chamber 35. The bottom plate inner surface 42*ds* is substantially planar and extends in the left-right direction.

The frame supply openings 37C, 37M, and 37Y (see FIG. 8) are openings formed in the frame bottom plates 42*d* on the lower side of the toner chambers 35C, 35M, and 35Y of the frame 42, respectively. The frame supply openings 37C, 37M, and 37Y allow the toner stored in the toner chambers 35C, 35M, and 35Y to pass therethrough. In the toner cartridge attachment direction Dm, the frame supply openings 37C, 37M, and 37Y have predetermined lengths and are spaced at predetermined intervals. The frame supply openings 37C, 37M, and 37Y have the same length in the toner cartridge attachment direction Dm.

The shutter 38 is disposed at a lower portion of the toner cartridge 23 slidably in the toner cartridge attachment direction Dm and toner cartridge removal direction Dd. The shutter 38 is a plate-shaped member that closes or opens the frame supply openings 37C, 37M, and 37Y, and forms the bottom surface of the toner cartridge 23.

In the shutter 38, the shutter supply openings 48C, 48M, and 48Y are formed. In the toner cartridge attachment direction Dm, the shutter supply openings 48C, 48M, and 48Y have the same lengths as the frame supply openings 37C, 37M, and 37Y, and are spaced at the same intervals as the frame supply openings 37C, 37M, and 37Y. Thus, when the shutter supply openings 48C, 48M, and 48Y are located at positions facing the frame supply openings 37C, 37M, and 37Y of the frame 42, the shutter 38 is in a shutter open state where the shutter 38 opens the frame supply openings 37C, 37M, and 37Y. On the other hand, when the shutter supply openings 48C, 48M, and 48Y are located at positions that do not face the frame supply openings 37C, 37M, and 37Y of the frame 42, the shutter 38 is in a shutter close state where the shutter 38 closes the frame supply openings 37C, 37M, and 37Y. The shutter supply openings 48C, 48M, and 48Y may be referred to as the shutter supply openings 48. FIG. 7B illustrates the shutter open state where the shutter 38 of the toner cartridge 23 opens the frame supply openings 37C, 37M, and 37Y.

As illustrated in FIG. 7B, when the shutter supply openings 48C, 48M, and 48Y of the shutter 38 are located at the positions facing the frame supply openings 37C, 37M, and 37Y, they open the frame supply openings 37C, 37M, and 37Y. Thus, the toner stored in the toner chambers 35C, 35M, and 35Y passes and falls through the frame supply openings 37C, 37M, and 37Y and the shutter supply openings 48C, 48M, and 48Y, and is supplied to the image forming portions 15C, 15M, and 15Y (see FIG. 3), respectively.

A transmission member 50 and the shutter hole 51 are disposed in the toner cartridge removal direction Dd from the shutter supply opening 48Y of the shutter 38 (see FIG. 8). The transmission member 50 engages the shutter 38 and abuts the spring 39. The shutter hole 51 is formed in the shutter 38, and engages the claw 31 (see FIG. 5) formed on the stage 24.

The spring 39 is housed in a spring housing portion 52 of the frame 42 disposed under a bottom surface forming the toner chamber 35Y. The spring housing portion 52 is closed by a cap 53. The spring 39 abuts the transmission member 50 engaging the shutter 38 to urge the shutter 38 in the toner cartridge attachment direction Dm. The shutter 38 is urged by the spring 39, abuts and is stopped by an abutment portion 54 at a lower portion of the toner cartridge 23, and is placed in the shutter close state where the shutter 38 closes the frame supply openings 37C, 37M, and 37Y of the toner chambers 35.

When the toner cartridge 23 is placed on the stage 24, the claw 31 (see FIG. 5) of the stage 24 engages the shutter hole 51 of the shutter 38, thereby limiting or preventing movement of the shutter 38 in the toner cartridge attachment direction Dm. Then, when the toner cartridge 23 is further pushed in the toner cartridge attachment direction Dm, the toner cartridge 23 is attached to the stage 24 and placed in the toner cartridge attachment state illustrated in FIG. 3. In the toner cartridge attachment state, the shutter 38 is in the shutter open state. In the shutter open state, the frame supply openings 37 of the toner cartridge 23 overlap or coincide with the shutter supply openings 48 of the shutter 38 and the stage supply openings 30 of the stage 24, thereby allowing the toner to be supplied from the toner chambers 35 to the image forming portions 15.

In the toner cartridge attachment state (see FIG. 3), the agitation gear 75 provided in the toner cartridge 23 meshes with the drive gear 32 and is rotated by a rotational drive force transmitted from the motor 55 (see FIG. 2) of the image forming apparatus 1. As the agitation gear 75 rotates, the agitating bar 60 (see FIG. 10) rotates, and the agitating films 61, support members 64C, support members 64M, and support members 64Y (see FIG. 8), which are disposed on the agitating bar 60, also rotate. The support members 64C, 64M, and 64Y may be referred to as the support members 64.

On the other hand, when the toner cartridge 23 is removed from the stage 24, the shutter 38 is moved in the toner cartridge attachment direction Dm by the restoring force of the spring 39 (see FIG. 8) and placed in the shutter close state.

<1-4-3. Configuration of Agitator>

As illustrated in FIG. 8, the agitator 40 is a rotatable member extending in the toner cartridge attachment direction Dm, and includes the agitating bar 60, agitating films 61 (i.e., agitating films 61C, 61M, and 61Y), and support members 64 (i.e., support members 64C, 64M, and 64Y).

<1-4-3-1. Configuration of Agitating Bar>

The agitating bar 60 has a substantially quadrangular prism shape, and is disposed to pass through a substantially central portion of the body 34 or substantially central portions of the toner chambers 35C, 35M, and 35Y. A front end portion of the agitating bar 60 is supported by a bearing disposed in the frame 42, and a rear end portion of the agitating bar 60 is supported in a hole provided in a rear end portion of the frame 42 and held by an E-ring 70. Sealing sponges (or sealing members) 72*a* and 72*b* are disposed between the agitating bar 60 and the partitions 36*a* and 36*b*, and prevent mixture of toner in the adjacent toner chambers 35.

Agitating bar mounting surfaces 60*a* are formed on a pair of sides of the agitating bar 60 (see FIG. 11) opposite each other. The agitating bar mounting surfaces 60*a* are planar surfaces extending in the front-rear direction. Multiple agitating bar engagement projections 60*b* are arranged in the front-rear direction on each of the agitating bar mounting surfaces 60*a*. The agitation gear 75 is attached to the rear end portion of the agitating bar 60 (see FIG. 8), which projects rearward beyond a rear end surface of the frame 42. A sealing sponge (or sealing member) 73 is attached to the rear end portion in front of the agitation gear 75. The agitation gear 75 is held on the agitating bar 60 by an E-ring 71. In the image forming apparatus 1 (see FIG. 1), under control of the controller 5, rotational drive from the motor 55 (see FIG. 2) is transmitted to the agitation gear 75 through the drive gear 32 (see FIG. 3), thereby rotating the agitator 40 in a forward rotational direction (or a first rotational direction) Df shown in FIG. 10. Thereby, the agitator 40 agitates the toner stored in the toner chambers 35C, 35M, and 35Y to prevent toner aggregation or the like and remove toner adhering the side wall inner surfaces 42*ss* and cap inner wall surfaces 44*s*.

Figure 9:
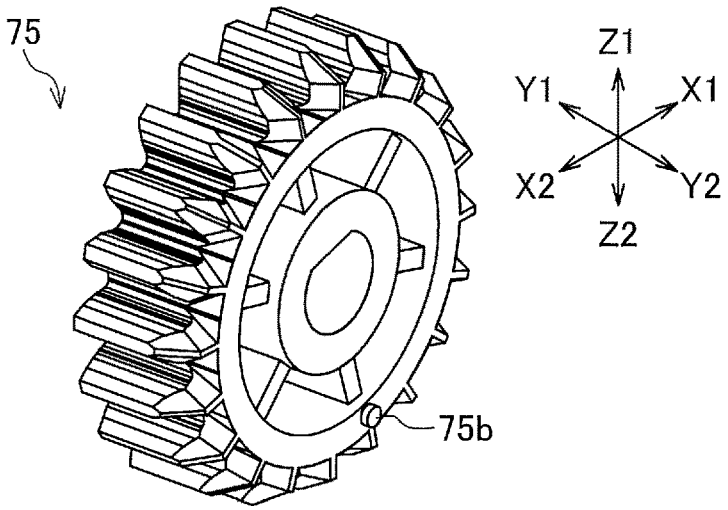
FIG. 9 is a perspective view illustrating an external configuration of an agitation gear.

As illustrated in FIG. 9, the projection 75*b* is disposed on a rear end surface of the agitation gear 75. The projection 75*b* is used to stop the agitating films 61 in a chamber separation state (to be described later) when the image forming apparatus 1 terminates a printing operation. Also, when the toner chambers 35 of the toner cartridge 23 are filled with toner by a worker during production of the toner cartridge 23, the projection 75*b* is used as a mark for moving the agitating films 61 to prevent the agitating films 61 from interfering the filling. The projection 75*b* is also used as a mark for preventing the agitating films 61 from continuously abutting and being deflected by the side wall inner surfaces 42*ss* and cap inner wall surfaces 44*s* for a long time while the toner cartridge 23 is transported or unused and thereby deforming or deteriorating.

<1-4-3-2. Configuration of Agitating Films>

Figure 11:
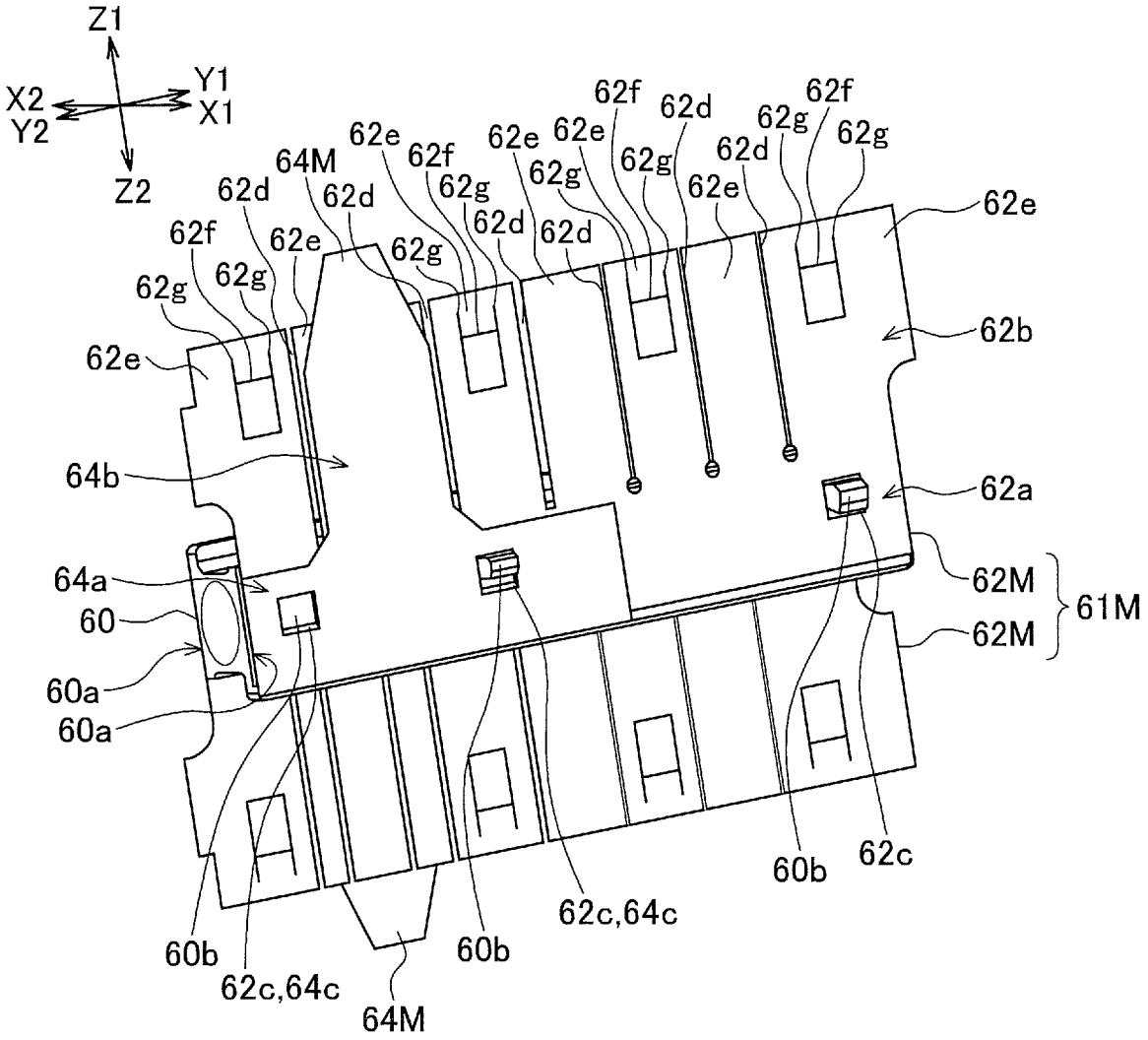
FIG. 11 is a perspective view illustrating an external configuration of agitating films of the first embodiment.

For each of the toner chambers 35C, 35M, and 35Y, the agitating film 61 for agitating the toner is disposed on the agitating bar 60 together with the support members 64 see FIG. 8). The agitating films 61C, 61M, and 61Y have substantially the same configuration, and the agitating film 61M will be representatively described below. As illustrated in FIG. 11, the agitating film 61M includes a pair of agitating films 62M as a first and second film portions. The agitating films 62M have substantially the same shape and have a positional relationship such that rotating the agitating films 62M about the agitating bar 60 by 180 degrees moves each agitating film 62M to the initial position of the other agitating film 62M.

Each agitating film 62M is a rectangular thin sheet member having flexibility as a whole, and includes an agitating film base portion 62*a* and an agitating film projecting portion 62*b*. The agitating film base portion 62*a* is elongated in the front-rear direction, and abuts one of the agitating bar mounting surfaces 60*a* of the agitating bar 60. The agitating film base portion 62*a* has multiple agitating film attachment holes 62*c* arranged in an agitating bar axial direction (or the front-rear direction) that is an axial direction of the agitating bar 60. The agitating film base portion 62*a* abuts the agitating bar mounting surface 60*a* of the agitating bar 60 with the agitating bar engagement projections 60*b* on the agitating bar mounting surface 60*a* of the agitating bar 60 fitted in the agitating film attachment holes 62*c*, and thereby the agitating film 62M is fixed to the agitating bar 60.

The agitating film projecting portion 62*b* is in the form of strips as a whole, and projects from the agitating film base portion 62*a* in an agitating film projecting direction substantially perpendicular to the agitating bar axial direction. The agitating film projecting portion 62*b* is separated into multiple agitating film strips 62*e* arranged in the agitating bar axial direction, by multiple agitating film separating slits 62*d* formed to extend in the agitating film projecting direction. The agitating film projecting portion 62*b* is longer than a distance from the agitating bar 60 to the side wall inner surface 42*ss* and a distance from the agitating bar 60 to the cap inner wall surface 44*s* (see FIG. 12B). Thereby, in the chamber separation state illustrated in FIG. 12B, leading ends of the agitating film projecting portions 62*b* abut the side wall inner surface 42*ss* and cap inner wall surface 44*s*. Thus, the agitating films 62M rotate in contact with the side wall inner surface 42*ss* and cap inner wall surface 44*s*.

Since the agitating films 62M are flexible, when the agitating film projecting portions 62*b* abut the side wall inner surface 42*ss* and cap inner wall surface 44*s*, the agitating film projecting portions 62*b* are deflected, and predetermined areas of the leading ends in the agitating film projecting direction abut the side wall inner surface 42*ss* and cap inner wall surface 44*s*. On the other hand, the agitating film projecting portions 62*b* are shorter than a distance from the agitating bar 60 to the top plate inner surface 42*us*, and thus do not abut the top plate inner surface 42*us* when the agitating films 62M rotate.

Near the leading end of the agitating film projecting portion 62*b*, rectangular agitating film holes 62*f* are formed in substantially every other agitating film strip 62*e*. For each agitating film hole 62*f*, agitating film slits 62*g* are formed in the agitating film strip 62*e* to extend from an edge (specifically, both ends in the agitating bar axial direction) of the agitating film hole 62*f* toward the leading end of the agitating film projecting portion 62*b* in the agitating film projecting direction.

Similarly to the agitating film 61M, the agitating film 61C includes a pair of agitating films 62C, and the agitating film 61Y includes a pair of agitating films 62Y. The agitating films 62C, 62M, and 62Y may be referred to as the agitating films 62.

<1-4-3-3. Configuration of Support Member>

The support members 64 include the support members 64C for the toner chamber 35C, the support members 64M for the toner chamber 35M, and the support members 64Y for the toner chamber 35Y. The support members 64C, 64M, and 64Y (see FIG. 8) have substantially the same configuration, and the support members 64M will be representatively described below. As illustrated in FIG. 11, the support members 64M are a pair of support members 64M having substantially the same shape and having a positional relationship such that rotating the Support members 64M about the agitating bar 60 by 180 degrees moves each support member 64M to the initial position of the other support member 64M.

Each support member 64M is a thin sheet member having, for example, a T-shape as a whole, and has a support member base portion 64*a* and a support member projecting portion 64*b*. The support member base portion 64*a* is elongated in the front-rear direction, and abuts the agitating film base portion 62*a* of one of the agitating films 62M. At a position corresponding to the frame supply opening 37 in the agitating bar axial direction, the support member projecting portion 64*b* projects from the support member base portion 64*a* in the agitating film projecting direction to the outside of the leading end of the agitating film projecting portion 62*b* in the agitating film projecting direction. The support member base portion 64*a* has multiple support member attachment holes 64*c* arranged in the agitating bar axial direction. The support member base portion 64*a* abuts the agitating film base portion 62*a* of the agitating film 62M with the agitating bar engagement projection 60*b* of the agitating bar 60 fitted in the support member attachment holes 64*c*, and thereby the support member 64M is fixed to the agitating bar 60 with the agitating film 62M therebetween. The support member 64M rotates together with the agitating film 62M, and supports discharge of the toner through the frame supply opening 37M and shutter supply opening 48M with the support member projecting portion 64*b* projecting downward beyond the frame supply opening 37M.

<1-4-3-4. Configuration of Claw Portion>

Portions of the frame 42 corresponding to the toner chambers 35C, 35M, and 35C (see FIG. 8) have substantially the same configuration, and the portion of the frame 42 corresponding to the toner chamber 35M will be representatively described below. Also, the caps 44C, 44M, and 44Y have substantially the same configuration, and the cap 44M will be representatively described below.

Figure 12A:
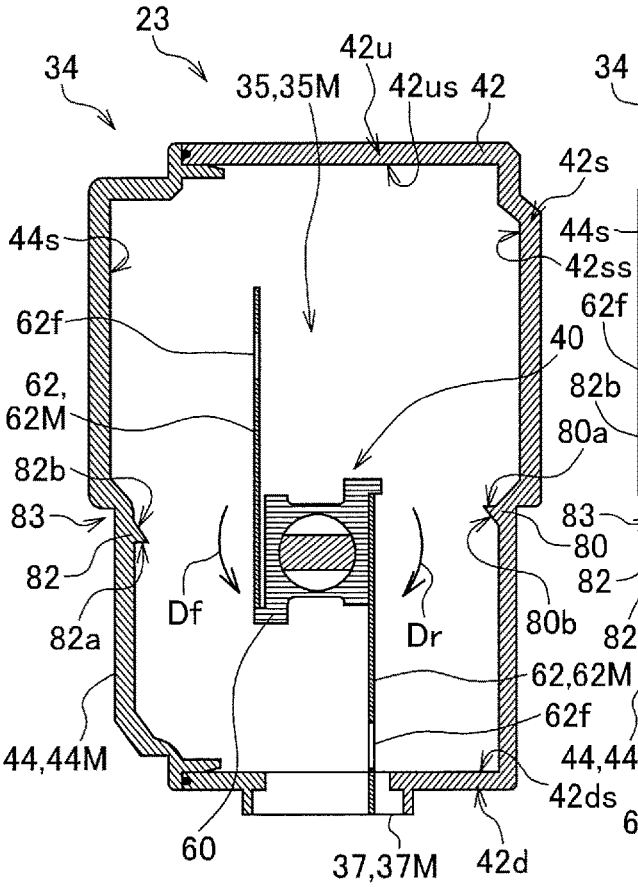
FIGS. 12A to 12E illustrate operation of the agitating films of the first embodiment, FIG. 12A being a sectional view taken along line B-B in FIG. 7A in a chamber open state, FIG. 12B being a sectional view taken along line B-B in FIG. 7A in a chamber separation state, FIG. 12C being an enlarged view illustrating configurations of one of the agitating films and a cap claw when the agitating films rotate in a forward rotational direction, FIGS. 12D and 12E being enlarged views illustrating configurations of one of the agitating films and the cap claw when the agitating films rotate in a reverse rotational direction.
Figure 12B:
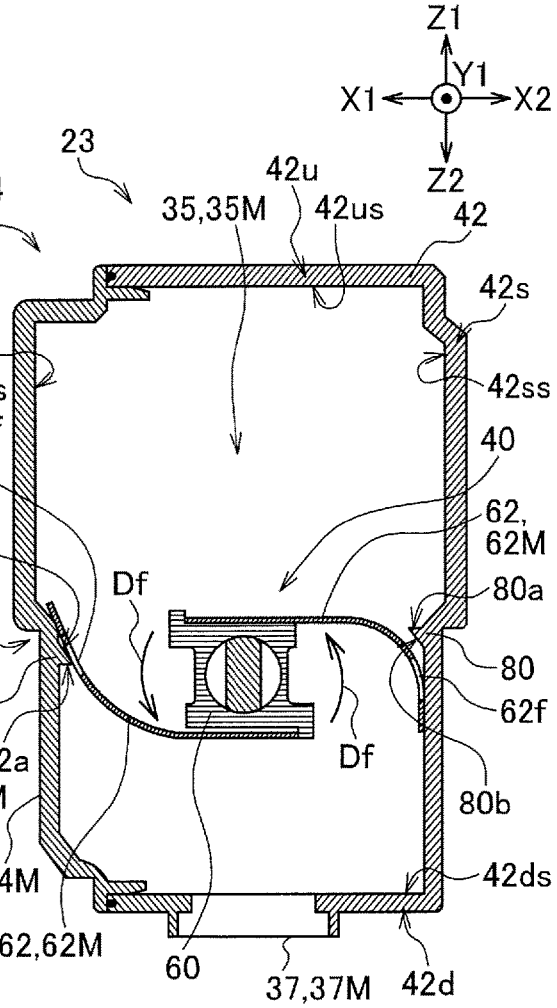

As illustrated in FIGS. 10, 12A, and 12B, frame claws 80 are formed at the same positions in the agitating bar axial direction as the agitating film holes 62*f* of the agitating films 62M (i.e., at positions facing the agitating film holes 62*f*), on a substantially central portion of the side wall inner surface 42*ss* of the frame side wall 428 in the up-down direction. Each frame claw 80 is substantially triangular when viewed from the front, and has an engagement surface 80*a* and a sliding surface 80*b*. The engagement surface 80*a* is a planar surface extending leftward from the side wall inner surface 42*ss* in the horizontal direction, and is a surface substantially perpendicular to rotational trajectories of the leading ends of the agitating films 62M rotating in a reverse rotational direction (or second rotational direction) Dr. Thus, the engagement surface 80*a* collides against the leading ends of the agitating films 62M rotating in the reverse rotational direction Dr, thereby preventing rotational movement of the agitating films 62M. The sliding surface 80*b* is a planar surface that slopes upward to the left from the side wall inner surface 42*ss* to a left end portion of the engagement surface 80*a*. The sliding surface 80*b* is a surface extending substantially along rotational trajectories of the leading ends of the agitating films 62M rotating in the forward rotational direction Df. Thus, the sliding surface 80*b* allows the leading ends of the agitating films 62M rotating in the forward rotational direction Df to slide thereon, and does not prevent rotational movement of the agitating films 62M.

Cap claws 82 are formed at the same positions in the front-rear direction as the agitating film holes 62*f* of the agitating films 62M (i.e., at positions facing the agitating film holes 62*f*), on a substantially central portion of the cap inner wall surface 44*s* of the cap 44M in the up-down direction. The cap claws 82 and frame claws 80 have shapes that are point-symmetric about the agitating bar 60. Each cap claw 82 is substantially triangular when viewed from the front, and has an engagement surface 82*a* and a sliding surface 82*b*. The engagement surface 82*a* and sliding surface 82*b* of the cap claw 82 and the engagement surface 80*a* and sliding surface 80*b* of the frame claw 80 are point-symmetric about the agitating bar 60.

Thus, on the inner wall of the body 34, the frame claws 80 and cap claws 82 are formed so that they face to each other in the left-right direction and the direction of engagement of the frame claws 80 with the rotating agitating films 62 is opposite to the direction of engagement of the cap claws 82 with the rotating agitating films 62. The frame claws 80 and cap claws 82 may be referred to as the claw portions 83.

<1-5. Operation, Advantages, and Others>

During production of the toner cartridge 23, a worker sees the position of the projection 75*b* (see FIG. 9) of the agitation gear 75, and adjusts the attitude of the agitating films 62 so that a direction in which the agitating films 62 extend is parallel to the up-down direction or perpendicular to a supply opening direction that is parallel to the left-right direction and in which the frame supply openings 37 and shutter supply openings 48 (see FIG. 8) extend, as illustrated in FIG. 12A, by rotating the agitation gear 75 in the forward rotational direction Df as appropriate. In this state, the agitating films 62 are parallel to the side wall inner surfaces 42*ss* and cap inner wall surfaces 44*s*.

Thus, the agitating films 62 are substantially parallel to the side wall inner surfaces 42*ss* and cap inner wall surfaces 44*s*, and the toner cartridge 23 is placed in a chamber open state where the toner chambers 35 are entirely opened to the outside through the frame supply openings 37. When the toner cartridge 23 is filled with toner during production thereof, the toner cartridge 23 is in the chamber open state, and the toner chambers 35 are not blocked by the agitating films 62, which allows the worker to easily supply toner to the toner chambers 35 through the frame supply openings 37.

Figure 12C:
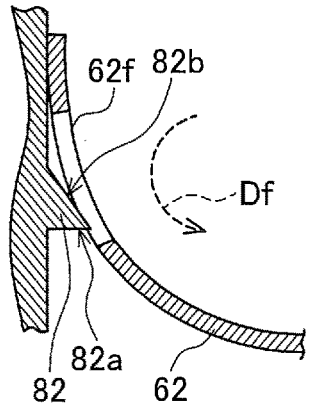

In an attached state where the toner cartridge 23 has been attached to the image forming apparatus 1, during a printing operation to perform printing, the controller 5 of the image forming apparatus 1 rotates the motor 55 to rotate the agitation gear 75 in the forward rotational direction Df and rotate the agitating films 62 in the forward rotational direction Df, thereby agitating the toner stored in the toner chambers 35 and removing toner adhering to the side wall inner surfaces 42*ss* and cap inner wall surfaces 44*s*. When the agitation gear 75 rotates in the forward rotational direction Df, as illustrated in FIG. 12C, the agitating films 62 normally rotate without being prevented from rotating while their leading ends abut or slide on the sliding surfaces 80*b* (not illustrated in FIG. 12C) of the frame claws 80 and the sliding surfaces 82*b* of the cap claws 82.

In the attached state, when operation of the image forming apparatus 1 is stopped (e.g., when the image forming apparatus 1 is turned off, or when a printing operation is terminated), the controller 5 of the image forming apparatus 1 stops the agitating films 62 in a horizontal attitude where a direction in which the agitating films 62, in particular the agitating film base portions 62*a* (see FIG. 11), extend is parallel to the supply opening direction, as illustrated in FIG. 12B, by rotating the motor 55 to rotate the agitation gear 75 in the forward rotational direction Df as appropriate while detecting the projection 75*b* of the agitation gear 75 with the rotation detection sensor 56. In this state, the agitating films 62 are substantially perpendicular to the side wall inner surfaces 42*ss* and cap inner wall surfaces 44*s*. At this time, the leading ends of the agitating film projecting portions 62*b* of the agitating films 62 abut the side wall inner surfaces 42*ss* and cap inner wall surfaces 44*s*, and are deflected substantially along the rotational direction of the agitating films 62.

Thus, the agitating films 62 form covers or partitions at substantially central portions of the toner chambers 35 in the up-down direction and place the toner cartridge 23 in the chamber separation state where the agitating films 62 separate the toner chambers 35 into upper parts and lower parts. In the chamber separation state, the toner cartridge 23 is in a state where the spaces of the toner chambers 35 above the agitating films 62 are blocked from the outside.

In the chamber separation state, the agitating films 62 prevent the toner located above the agitating films 62 in the toner chambers 35 from falling below the agitating films 62. Thus, the toner in the toner chambers 35 are separated into a part above the agitating films 62 and a part below the agitating films 62. Thus, the pressure of the toner located above the agitating films 62 is exerted on the agitating films 62 and is not exerted on the toner located below the agitating films 62.

Thereby, in particular when a large amount of toner remains in the toner chambers 35, the image forming apparatus 1 can prevent the toner located in the lower parts of the toner chambers 35 from being subjected to excessive pressure from the toner located in the upper parts of the toner chambers 35. Thus, the image forming apparatus 1 can prevent the toner located in the lower parts of the toner chambers 35 from aggregating and deteriorating, thereby improving print quality. In particular, when an image forming apparatus is turned off, it is possible that a long time elapses before the image forming apparatus is turned on again and a printing operation is performed, and toner located in a lower part of a toner chamber is subjected to excessive pressure from toner located in an upper part of the toner chamber for a long time.

In contrast, when the image forming apparatus 1 terminates a printing operation or is turned off, the image forming apparatus 1 places the toner cartridge 23 in the chamber separation state. Thereby, when a long time elapses before a printing operation is performed after that, it is possible to prevent the toner located in the lower parts of the toner chambers 35 from being continuously subjected to excessive pressure from the toner located in the upper parts of the toner chambers 35 for a long time, thereby preventing the toner from deteriorating.

Further, the image forming apparatus 1 is configured so that in the chamber separation state, the leading ends of the agitating film projecting portions 62*b* of the agitating films 62 abut the side wall inner surfaces 42*ss* and cap inner wall surfaces 44*s*, and are deflected substantially along the rotational direction of the agitating films 62. Thus, it is possible to securely prevent toner located on the upper side of the agitating films 62 from leaking to the lower side of the agitating films 62, compared to a case where just the tips of the agitating films 62 simply abut the side wall inner surfaces 42*ss* and cap inner wall surfaces 44*s*.

Further, from viewpoints of consideration for the global environment and the like, it is conceivable, when the toner in the toner chambers 35 has run out, to refill the toner cartridge 23 with toner to reuse the toner cartridge 23. After a printing operation ends, until a next printing operation starts, the image forming apparatus 1 places the toner cartridge 23 in the chamber separation state, and thus the agitating films 62 are continuously in contact with and deflected by the side wall inner surfaces 42*ss* and cap inner wall surfaces 44*s*, which may tend to deform or deteriorate the agitating films 62. Since deformation or deterioration of the agitating films 62 reduces the agitating performance, it is preferable, when refilling the toner cartridge 23 with toner, to replace the agitating films 62 with new ones to maintain print quality.

Figure 12D:
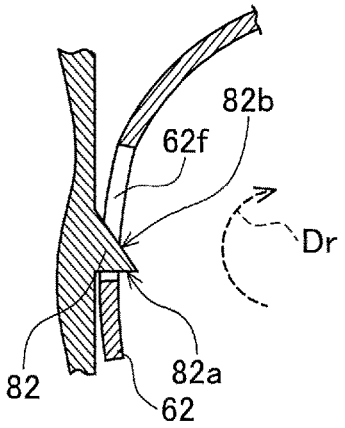
Figure 12E:
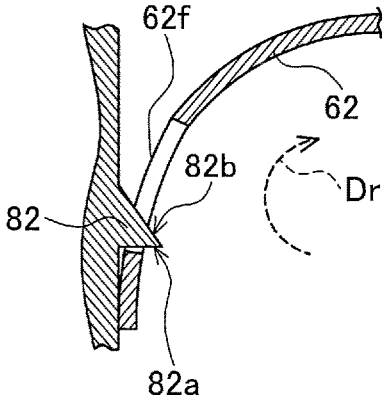

In refilling of the toner cartridge 23 with toner, when a worker rotates the agitation gear 75 in the reverse rotational direction Dr, as illustrated in FIG. 12D, the engagement surfaces 80*a* (not illustrated in FIG. 12D) of the frame claws 80 and the engagement surfaces 82*a* of the cap claws 82 enter the agitating film holes 62*f* of the agitating films 62. When the agitation gear 75 is further rotated in the reverse rotational direction Dr, as illustrated in FIG. 12E, the engagement surfaces 80*a* (not illustrated in FIG. 12E) of the frame claws 80 and the engagement surfaces 82*a* of the cap claws 82 are caught in the agitating film holes 62*f*.

In this state, when the agitation gear 75 is further rotated in the reverse rotational direction Dr, the agitating films 62 tear or split from the agitating film slits 62*g* provided in the agitating films 62 and break. When the agitating films 62 break; an abnormal sound occurs from the toner cartridge 23. With the abnormal sound, the toner cartridge 23 can inform the worker that the agitating films 62 should be replaced with new ones, and prompt the worker to replace the agitating films 62.

Further, in the attached state, when the controller 5 of the image forming apparatus 1 determines, by the dot count method, that the amount of remaining toner in any of the toner chambers 35C, 35M, and 35Y has become less than or equal to a predetermined amount (e.g., any of the toner chambers 35C, 35M, and 35Y has become empty), the controller 5 places the toner cartridge 23 in the chamber separation state (see FIG. 12B) by rotating the agitating films 62 in the forward rotational direction Df as appropriate.

Here, the toner cartridge 23 has the toners of the three colors of cyan, magenta, and yellow respectively stored in the toner chambers 35C, 35M, and 35Y. Thus, for example, when the toner chamber 35Y has become empty, some toner may remain in the toner chambers 35C and 35M. Thus, from viewpoints of consideration for the global environment and the like, it is conceivable, when any of the toner chambers 35 has become empty, to take remaining toner from the toner cartridge 23 and reuse the remaining toner by supplying it to another toner cartridge.

Regarding this, when any of the toner chambers 35 has become empty, the image forming apparatus 1 places the toner cartridge 23 in the chamber separation state, thereby preventing the toner remaining in the toner cartridge 23 from deteriorating due to the pressure before the remaining toner is taken from the toner cartridge 23 and reused.

As above, the image forming apparatus 1 includes the body 34, agitating bar 60, agitating films 62, controller 5, and image forming portion 15. The body 34 includes the frame bottom plates 42*d* as bottom plates, the frame side walls 42*s* and caps 44 as pairs of side walls facing each other, the toner chambers 35 as developer chambers formed by the frame bottom plates 42*d*, frame side walls 42*s*, and caps 44 for storing toner as developer, and the frame supply openings 37 disposed in the frame bottom plates 42*d* as supply openings that allow the toner chambers 35 to communicate with the outside of the toner chambers 35 and allow the toner to be supplied from the toner chambers 35 to the outside of the toner chambers 35. The agitating bar 60 is disposed between the frame side walls 42*s* and caps 44. The agitating films 62 are configured to rotate about the agitating bar 60 in the forward rotational direction Df to agitate the toner stored in the toner chambers 35. The controller 5 is configured to rotate the agitating films 62 so that the agitating films 62 are stopped in a state where the agitating films 62 abut each of the frame side walls 42*s* and caps 44. The image forming portions 15 are configured to form images with the toner supplied through the frame supply openings 37.

For magenta, the toner cartridge 23 includes the body 34, agitating bar 60, and agitating film 61M. The body 34 includes the frame bottom plate 42*d* as a bottom plate; the frame side wall 42*s* as a first side wall; the cap 44M as a second side wall facing the frame side wall 42*s*; the toner chamber 35M as a developer chamber that is defined by the frame bottom plate 42*d*, frame side wall 42*s*, and cap 44M and that stores toner as developer; and the frame supply opening 37M as an opening formed in the frame bottom plate 42*d* to allow the toner chamber 35M to communicate with the outside of the toner chamber 35M and allow the toner to be supplied from the toner chamber 35M to the outside of the toner chamber 35M. The agitating bar 60 is configured to rotate to agitate the toner stored in the toner chamber 35M. The agitating film 61M is attached to the agitating bar 60, and configured to, when rotation of the agitating bar 60 stops, stop in a state where the agitating film 61M abuts the frame side wall 42*s* and the cap 44M. In one aspect, the agitating film 61 includes the agitating films 62 as first and second film portions that abut the frame side wall 42*s* and cap 44M when rotation of the agitating bar 60 stops.

Thus, the image forming apparatus 1 can prevent the toner located above the agitating films 61 in the toner chambers 35 from falling below the agitating films 61 and prevent the toner located above the agitating films 61 from pressing the toner located below the agitating films 61, thereby preventing the toner from deteriorating.

2. Second Embodiment

<2-1. Configuration of Image Forming Apparatus and Image Forming Unit>

As illustrated in FIGS. 1 and 3, an image forming apparatus 101 according to a second embodiment differs from the image forming apparatus 1 according to the first embodiment in having an image forming unit 122 instead of the image forming unit 22, but is otherwise the same. As illustrated in FIGS. 3 and 4, the image forming unit 122 of the second embodiment differs from the image forming unit 22 of the first embodiment in having a toner cartridge 123 instead of the toner cartridge 23, but is otherwise the same.

<2-2. Configuration of Toner Cartridge>

Figure 13A:
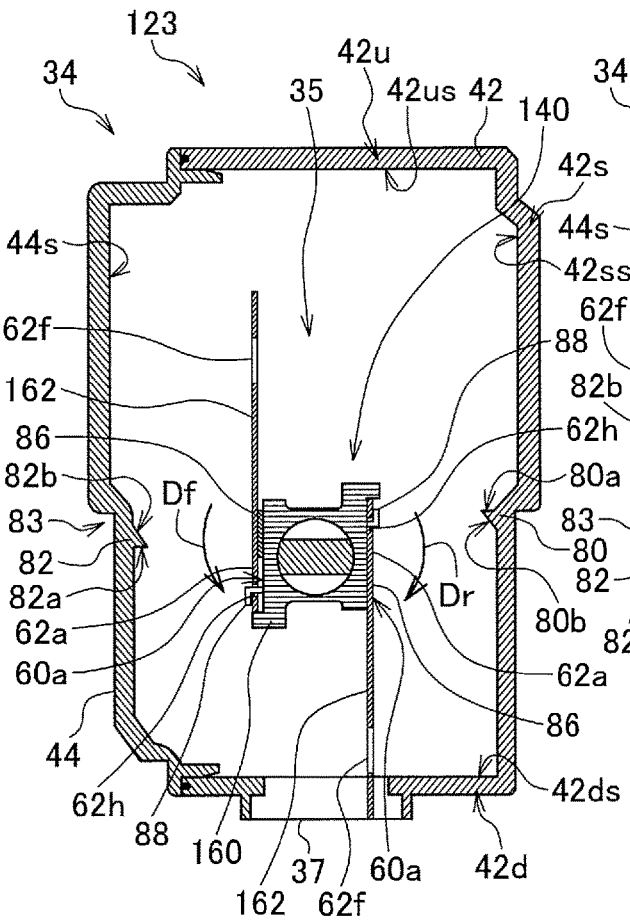
FIGS. 13A and 13B are first sectional views illustrating operation of agitating films of a second embodiment.
Figure 13B:
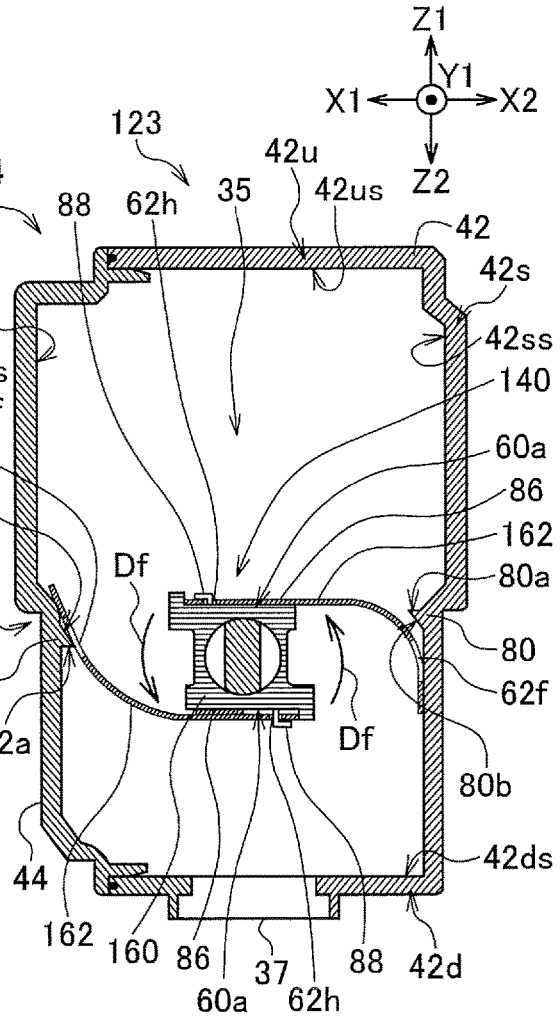

As illustrated in FIGS. 13A and 13B, the toner cartridge 123 of the second embodiment differs from the toner cartridge 23 of the first embodiment in having an agitator 140 instead of the agitator 40, but is otherwise the same. In FIGS. 13A and 13B, elements corresponding to those in FIGS. 12A and 12B are given the same reference characters.

<2-3. Configuration of Agitator>

As illustrated in FIGS. 13A and 13B, the agitator 140 of the second embodiment differs from the agitator 40 of the first embodiment in additionally having pieces of double-sided tape 86 and having an agitating bar 160 instead of the agitating bar 60 and agitating films 162 instead of the agitating films 62, but is otherwise the same.

As illustrated in FIG. 13A, the agitating bar 160 of the second embodiment has multiple agitating bar hooks 88 arranged in the front-rear direction. The agitating bar hooks 88 are disposed on the downstream sides of the agitating bar mounting surfaces 60*a* in the forward rotational direction Df to project from the agitating bar 160. The agitating bar hooks 88 are L-shaped, project from the agitating bar mounting surfaces 60*a*, and are bent downstream in the forward rotational direction Df. The agitating films 162 of the second embodiment differs from the agitating films 62 of the first embodiment in that the agitating film slits 62*g* are not provided, but are otherwise the same.

The pieces of double-sided tape 86 are attached between the downstream sides of the agitating film base portions 62*a* of the agitating films 162 in the reverse rotational direction Dr and the agitating bar mounting surfaces 60*a* of the agitating bar 160. The agitating films 162 have holes 62*h* in which the agitating bar hooks 88 of the agitating bar 60 are fitted. The holes 62*h* are formed on the downstream sides of the agitating film base portions 62*a* in the forward rotational direction Df. The agitating film base portions 62*a* of the agitating films 162 are attached to the agitating bar mounting surfaces 60*a* of the agitating bar 160 with the pieces of double-sided tape 86, and the agitating bar hooks 88 of the agitating bar 160 are fitted in the holes 62*h*. Thereby, the agitating films 162 are fixed to the agitating bar 160.

In this configuration, when the agitating films 162 rotate in the forward rotational direction Df, as illustrated in FIG. 13B, the agitating films 162 normally rotate without being prevented from rotating while their leading ends abut or slide on the sliding surfaces 80*b* of the frame claws 80 and the sliding surfaces 82*b* of the cap claws 82.

Figure 14A:
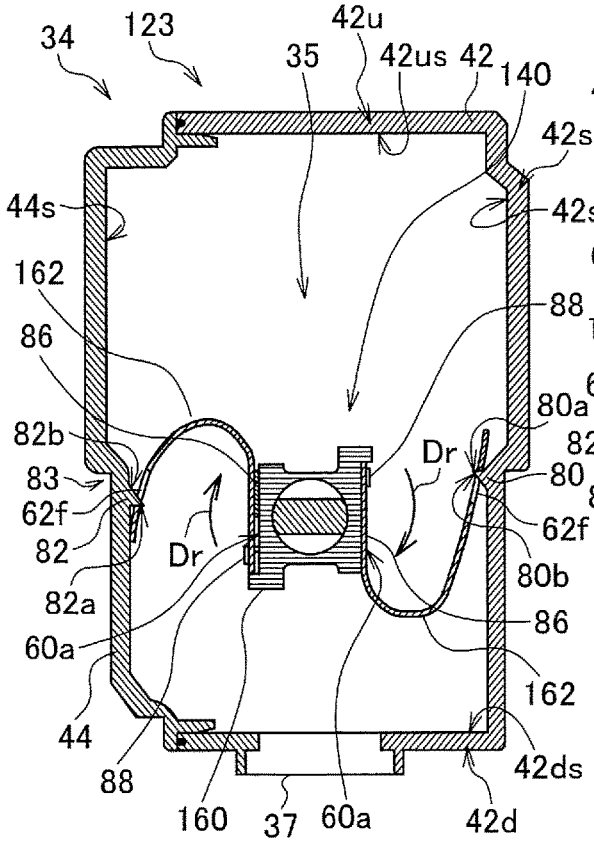
FIGS. 14A to 14C are second sectional views illustrating operation of the agitating films of the second embodiment.
Figure 14B:
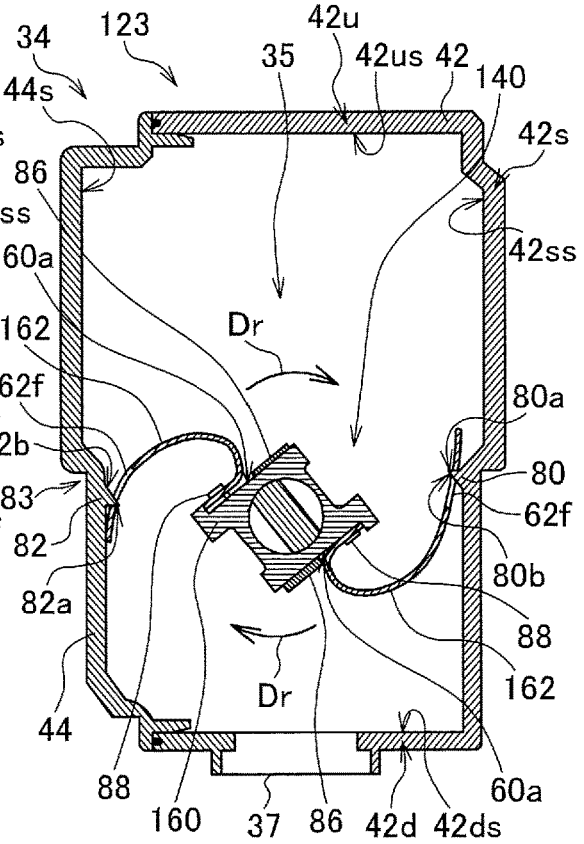
Figure 14C:
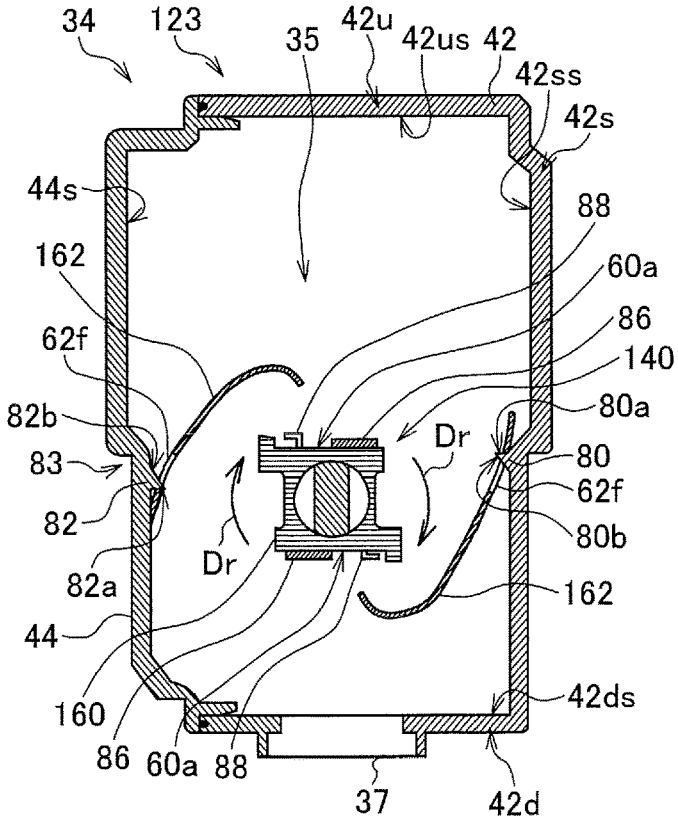

In refilling of the toner cartridge 123 with toner, when a worker rotates the agitation gear 75 in the reverse rotational direction Dr, as illustrated in FIG. 14A, the engagement surfaces 80*a* of the frame claws 80 and the engagement surfaces 82*a* of the cap claws 82 enter and catch the agitating film holes 62*f* of the agitating films 162, thereby preventing rotation of the agitating films 162. In this state, when the agitation gear 75 is further rotated in the reverse rotational direction Dr, as illustrated in FIG. 14B, the agitating films 162 come off the pieces of double-sided tape 86. In this state, when the agitation gear 75 is further rotated in the reverse rotational direction Dr, as illustrated in FIG. 14C, the agitating films 162 come off the agitating bar hooks 88 and thus come off the agitating bar 160.

When the agitating films 162 come off the agitating bar 160, an abnormal sound occurs from the toner cartridge 123. With the abnormal sound, the toner cartridge 123 can inform the worker that the agitating films 162 should be replaced with new ones, and prompt the worker to replace the agitating films 162. In addition, the toner cartridge 123 can simplify the operation of removing the agitating films 162 from the agitating bar 160. As such, the toner cartridge 123 is configured so that while the agitating films 162 do not come off the agitating bar 160 when rotating in the forward rotational direction, the agitating films 162 easily come off the agitating bar 160 when rotating in the reverse rotational direction.

3. Other Embodiments

In the above first embodiment, each agitating film 61 includes the pair of agitating films (or film portions) 62. However, this is not mandatory. For example, each agitating film 61 may be a single piece of film.

In the above first embodiment, the agitating films 62 are stopped in a horizontal direction where the agitating films 62 are substantially parallel to the supply opening direction. However, this is not mandatory. The agitating films 62 need not necessarily be substantially parallel to the supply opening direction, and it is sufficient that the agitating films 62 abut each of the frame side walls 42*s* and caps 44, which face each other with the agitating bar 60 therebetween. The same applies to the second embodiment.

In the above first embodiment, the agitating film slits 62*g* are formed to extend from both ends of each agitating film hole 62*f* in the agitating bar axial direction (see FIG. 11). However, this is not mandatory. It is also possible that an agitating film slit 62*g* is formed to extend from only one end of each agitating film hole 62*f* in the agitating bar axial direction. In this case, if the agitation gear 75 were rotated in the reverse rotational direction Dr in the attached state and the agitating films 62 were broken, it would be unlikely that the agitating films 62 would produce broken pieces and the broken pieces would reach and adversely affect the image forming portions 15.

In the above embodiments, the agitating film holes 62*f* are disposed in the leading ends of every other agitating film strip 62*e* (see FIG. 11). However, this is not mandatory. The agitating film holes 62*f* may be disposed in the leading ends of all or a subset of the multiple agitating film strips 62*e* in various manners. For example, the agitating film holes 62*f* may be disposed in every three agitating film strips 62*e*.

In the above embodiments, the agitating bar 60 or 160 is disposed at a substantially central portion of the body 34 (see FIGS. 12A and 12B). However, this is not mandatory. The agitating bar 60 or 160 may be disposed at a position shifted upward or downward from a central portion of the body 34.

In the above embodiments, the agitating films 62 or 162 abut the side wall inner surfaces 42*ss* and cap inner wall surfaces 44*s*, but do not abut the top plate inner surfaces 42*us* (see FIGS. 12A and 12B). However, this is not mandatory. The agitating films 62 or 162 may abut the top plate inner surfaces 42*us* in addition to the side wall inner surfaces 42*ss* and cap inner wall surfaces 44*s*.

In the above embodiments, transverse sections of portions of the body 34 corresponding to the toner chambers 35 are rectangular (see FIGS. 12A and 12B). However, this is not mandatory. Transverse sections of portions of the body 34 corresponding to the toner chambers 35 may have other various shapes. It is sufficient that the toner chambers 35 be formed by the frame bottom plates 42*d* with the frame supply openings 37 formed therein, and the frame side walls 42*s* and cap inner wall surfaces 44*s* facing each other with the agitating bar 60 therebetween.

When an operation is terminated, the agitating films 62 or 162 may be rotated by about one revolution in the reverse rotational direction Dr. This can facilitate engagement of the agitating films 62 or 162 with the frame claws 80 and cap claws 82 in refilling the toner cartridge 23 or 123 with toner, thereby preventing failing to replace the agitating films 62 or 162.

In the above embodiments, the frame claws 80 and cap claws 82 are provided. However, this is not mandatory. Either the frame claws 80 or the cap claws 82 may be omitted.

In the above embodiments, the amount of toner remaining in each toner chamber 35 is detected by dot count method. However, this is not mandatory. The amount of toner remaining in each toner chamber 35 may be detected by other various methods or sensors, such as optical sensors.

In the above embodiments, the present invention is applied to the image forming apparatus 1 or 101 employing a direct transfer system. However, this is not mandatory. The present invention is also applicable to image forming apparatuses or printers employing various systems, such as an intermediate transfer system in which toner images primarily transferred on an intermediate transfer belt are secondarily transferred onto a sheet of paper.

In the above embodiments, the present invention is applied to the image forming apparatus 1 or 101 using the three image forming portions 15. However, this is not mandatory. The present invention is also applicable to monochrome image forming apparatuses using a single image forming portion and image forming apparatuses using two, four, or more image forming portions.

In the above embodiments, the present invention is applied to the toner cartridge 23 or 123 having the three toner chambers 35. However, this is not mandatory. The present invention is also applicable to toner cartridges having one, two, four, or more toner chambers 35, as long as the number of toner chambers 35 corresponds to the number of image forming portions 15.

In the above embodiments, the present invention is applied to the image forming apparatus 1 or 101, which is an electrophotographic printer. However, the present invention is also applicable to other apparatuses, such as multi-function printers (MFPs), copiers, and facsimile machines.

In the above embodiments, the image forming apparatus 1 is constituted by the body 34, agitating films 62, controller 5, and image forming portions 15. However, the image forming apparatus may be constituted by other various types of bodies, agitating films, controllers, and image forming portions.

The present invention is also applicable to various apparatuses including toner cartridges storing developer.

The present disclosure includes the following aspects:

1. A developer container comprising:
   a body including:
   a bottom plate;
   a pair of side walls facing each other;
   a developer chamber formed by the bottom plate and the pair of side walls, the developer chamber storing developer; and
   a supply opening disposed in the bottom plate to allow the developer chamber to communicate with an outside of the developer chamber and allow the developer to be supplied from the developer chamber to the outside of the developer chamber;
   an agitating bar disposed between the pair of side walls; and
   at least one agitating film configured to rotate about the agitating bar in a forward rotational direction to agitate the developer stored in the developer chamber, and configured to stop in a state where the at least one agitating film abuts each of the pair of side walls.
2. The developer container of aspect 1, wherein in the state, the at least one agitating film separates the developer in the developer chamber into an upper part above the at least one agitating film and a lower part below the at least one agitating film.
3. The developer container of aspect 1 or 2, wherein in the state, the at least one agitating film is substantially parallel to the supply opening.
4. The developer container of any one of aspects 1 to 3, wherein in the state, a leading end of the at least one agitating film abuts one of the pair of side walls and is deflected along the forward rotational direction of the at least one agitating film.
5. The developer container of any one of aspects 1 to 4, wherein the at least one agitating film comprises a pair of agitating films disposed on both sides of the agitating bar.
6. The developer container of any one of aspects 1 to 5, wherein
   the at least one agitating film has a hole near a leading end of the at least one agitating film; and
   one of the pair of side walls has an inner surface provided with a claw at a position facing the hole, the claw entering the hole when the at least one agitating film rotates in a reverse rotational direction.
7. The developer container of aspect 6, wherein the at least one agitating film has a slit extending from an edge of the hole toward the leading end of the at least one agitating film.
8. The developer container of aspect 6 or 7, wherein when the at least one agitating film rotates in the reverse rotational direction from the state, the claw engages the hole to prevent the at least one agitating film from rotating.
9. An image forming unit comprising:
   the developer container of any one of aspects 1 to 8; and
   an image forming portion configured to form an image with the developer supplied through the supply opening.
10. An image forming apparatus comprising:
   a body including:
   a bottom plate;
   a pair of side walls facing each other;
   a developer chamber formed by the bottom plate and the pair of side walls, the developer chamber storing developer; and
   a supply opening disposed in the bottom plate to allow the developer chamber to communicate with an outside of the developer chamber and allow the developer to be supplied from the developer chamber to the outside of the developer chamber;
   an agitating bar disposed between the pair of side walls;
   at least one agitating film configured to rotate about the agitating bar in a forward rotational direction to agitate the developer stored in the developer chamber;
   a controller configured to rotate the at least one agitating film so that the at least one agitating film stops in a state where the at least one agitating film abuts each of the pair of side walls; and
   an image forming portion configured to form an image with the developer supplied through the supply opening.
11. The image forming apparatus of aspect 10, wherein the controller stops the at least one agitating film in the state when the image forming apparatus is turned off.
12. The image forming apparatus of aspect 10 or 11, wherein the controller stops the at least one agitating film in the state when a printing is terminated.
13. The image forming apparatus of any one of aspects 10 to 12, wherein the controller stops the at least one agitating film in the state when an amount of the developer in the developer chamber has become less than or equal to a predetermined amount.
14. A developer container control method comprising:
   controlling a developer container including:
   a body including:
   a bottom plate;
   a pair of side walls facing each other;
   a developer chamber formed by the bottom plate and the pair of side walls, the developer chamber storing developer; and
   a supply opening disposed in the bottom plate to allow the developer chamber to communicate with an outside of the developer chamber and allow the developer to be supplied from the developer chamber to the outside of the developer chamber;
   an agitating bar disposed between the pair of side walls; and
   at least one agitating film configured to rotate about the agitating bar in a forward rotational direction to agitate the developer stored in the developer chamber,
   wherein the controlling includes:

detecting a rotational attitude of the at least one agitating film; and rotating the at least one agitating film so that the at least one agitating film stops in a state where the at least one agitating film abuts each of the pair of side walls.

The present invention is not limited to the embodiments described above; it can be practiced in various other aspects without departing from the invention scope.

What is claimed is:

1. A developer container comprising:

a body including:

a bottom plate;

a first side wall;

a second side wall facing the first side wall;

a developer chamber defined by the bottom plate, the first side wall, and the second side wall, the developer chamber storing developer; and an opening formed in the bottom plate to allow the developer chamber to communicate with an outside of the developer chamber and allow the developer to be supplied from the developer chamber to the outside of the developer chamber;

an agitating bar configured to rotate to agitate the developer stored in the developer chamber; and at least one agitating film attached to the agitating bar and configured to, when rotation of the agitating bar stops, stop in a state where the at least one agitating film abuts the first side wall and the second side wall, wherein the at least one agitating film rotates in a first rotational direction when the agitating bar rotates to agitate the developer;

the at least one agitating film has a hole near a leading end of the at least one agitating film; and one of the first side wall and the second side wall has an inner surface provided with a claw at a position facing the hole, the claw entering the hole when the at least one agitating film rotates in a second rotational direction opposite the first rotational direction.

2. The developer container of claim 1, wherein the at least one agitating film includes a first agitating film that abuts the first side wall when rotation of the agitating bar stops, and a second agitating film that abuts the second side wall when rotation of the agitating bar stops.

3. The developer container of claim 1, wherein in the state, the at least one agitating film separates the developer in the developer chamber into an upper part above the at least one agitating film and a lower part below the at least one agitating film.

4. The developer container of claim 3, wherein in the state, the at least one agitating film is substantially parallel to the opening.

5. The developer container of claim 3, wherein in the state, the leading end of the at least one agitating film abuts one of the first side wall and the second side wall, and is deflected along a direction in which the at least one agitating film rotates.

6. The developer container of claim 3, wherein the at least one agitating film includes a pair of agitating films disposed on both sides of the agitating bar.

7. The developer container of claim 1, wherein the at least one agitating film has a slit extending from an edge of the hole toward the leading end of the at least one agitating film.

8. The developer container of claim 1, wherein when the at least one agitating film rotates in the second rotational direction from the state, the claw engages the hole to prevent the at least one agitating film from rotating.

9. An image forming unit comprising:

the developer container of claim 1; and an image forming portion configured to form an image with the developer supplied through the opening.

10. An image forming apparatus comprising:

an image forming unit of claim 9; and a controller configured to rotate the at least one agitating film so that the at least one agitating film stops in the state.

11. The image forming apparatus of claim 10, wherein the controller stops the at least one agitating film in the state when the image forming apparatus is turned off.

12. The image forming apparatus of claim 10, wherein the controller stops the at least one agitating film in the state when a printing is terminated.

13. The image forming apparatus of claim 10, wherein the controller stops the at least one agitating film in the state when an amount of the developer in the developer chamber has become less than or equal to a predetermined amount.

14. A developer container control method comprising:

controlling a developer container including:

a body including:

a bottom plate;

a first side wall;

a second side wall facing the first side wall;

a developer chamber defined by the bottom plate, the first side wall, and the second side wall, the developer chamber storing developer; and an opening formed in the bottom plate to allow the developer chamber to communicate with an outside of the developer chamber and allow the developer to be supplied from the developer chamber to the outside of the developer chamber;

an agitating bar configured to rotate to agitate the developer stored in the developer chamber; and at least one agitating film attached to the agitating bar, wherein the at least one agitating film rotates in a first rotational direction when the agitating bar rotates to agitate the developer;

the at least one agitating film has a hole near a leading end of the at least one agitating film; and one of the first side wall and the second side wall has an inner surface provided with a claw at a position facing the hole, the claw entering the hole when the at least one agitating film rotates in a second rotational direction opposite the first rotational direction, and wherein the controlling includes:

detecting a rotational attitude of the at least one agitating film; and rotating the at least one agitating film so that the at least one agitating film stops in a state where the at least one agitating film abuts the first side wall and the second side wall.

* * * * *